US012516450B1

(12) United States Patent
Siddiquee et al.

(10) Patent No.: US 12,516,450 B1
(45) **Date of Patent: *Jan. 6, 2026**

(54) CARBON FIBER PRODUCTION FROM HEAVY VACUUM GAS OIL DERIVED ASPHALTENES

(71) Applicant: King Fahd University of Petroleum and Minerals, Dhahran (SA)

(72) Inventors: Muhammad Nurunnabi Siddiquee, Dhahran (SA); Mohammad M. Hossain, Dhahran (SA); Mustafa Mohammed Ali Amin, Dhahran (SA); Ajay Sharma, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 19/250,890

(22) Filed: Jun. 26, 2025

Related U.S. Application Data

(63) Continuation of application No. 19/218,101, filed on May 23, 2025.

(60) Provisional application No. 63/788,493, filed on Apr. 14, 2025.

(51) Int. Cl.
*D01F 9/14* (2006.01)
*D01D 5/08* (2006.01)

(52) U.S. Cl.
CPC ..... *D01F 9/14* (2013.01); *D01D 5/08* (2013.01); *D10B 2101/12* (2013.01)

(58) Field of Classification Search
None
See application file for complete search history.

(56) References Cited

U.S. PATENT DOCUMENTS 4,440,624 A 4/1984 Uemura et al.
5,198,101 A 3/1993 Kalback
(Continued)

FOREIGN PATENT DOCUMENTS

EP 4570974 A1 * 6/2025 ..... B29B 15/14
JP 2018500480 A * 1/2018 ..... D01F 9/22
WO 2023/114565 A1 6/2023

OTHER PUBLICATIONS

Lahmady S. Mohamed, et al., "Investigation of controlled autoxidation of HVGO to produce carbon fibres precursors: Role of oxygen availability and mixing", Chemical Engineering Research and Design, vol. 205, May 2024, pp. 433-442, 8 Pages.

*Primary Examiner* — Farah Taufiq
(74) *Attorney, Agent, or Firm* — Oblon, McClelland, Maier & Neustadt, L.L.P.

(57) ABSTRACT

A method of forming a carbon fiber includes heat treating a heavy vacuum gas oil at a heat treatment temperature of 125 to 225° C. with a gas mixture comprising oxygen to form an oxidized HVGO. The method further includes collecting asphaltenes from the oxidized HVGO, melt spinning the asphaltenes to form a raw filament, treating the raw filament with a mineral acid to form an acid-treated filament, oxidizing the acid-treated filament by heating the acid-treated filament in air at a temperature of 125 to 175° C. to form an oxidized filament, and carbonizing the oxidized filament by heating the oxidized filament under an inert atmosphere at a temperature of 700 to 900° C. to form the carbon fiber.

20 Claims, 19 Drawing Sheets

(56) References Cited

U.S. PATENT DOCUMENTS

| | | | | |
|---|---|---|---|---|
| 2015/0038041 | A1* | 2/2015 | Zhamu | D03D 15/00 210/500.1 |
| 2019/0390370 | A1* | 12/2019 | Nakano | D01F 9/22 |
| 2023/0020290 | A1 | 1/2023 | Remesat | |

* cited by examiner

CARBON FIBER PRODUCTION FROM HEAVY VACUUM GAS OIL DERIVED ASPHALTENES

CROSS REFERENCE TO RELATED APPLICATION

This application is a continuation of U.S. patent application Ser. No. 19/218,101, filed on May 23, 2025, claims benefit of priority to U.S. Provisional Patent Application 63/788,493 having a filing date of Apr. 14, 2025, and which is incorporated here by reference in its entirety.

STATEMENT OF PRIOR DISCLOSURE BY AN INVENTOR

Aspects of the present disclosure are described in Lahmady S. Mohamed, et. al, "Investigation of controlled autoxidation of HVGO to produce carbon fibres precursors: Role of oxygen availability and mixing," *Chemical Engineering Research and Design Volume* 205, May 2024, Pages 433-442 which is incorporated here by reference in its entirety.

STATEMENT OF ACKNOWLEDGEMENT

Support provided by the Interdisciplinary Research Center for Refining & Advanced Chemicals (IRC-RAC) at King Fahd University of Petroleum & Minerals (KFUPM) under study No. INRC 2409 is gratefully acknowledged.

BACKGROUND

Technical Field

The present disclosure relates to carbon material processing and petroleum refining and more particularly, the present disclosure pertains to methods for converting heavy petroleum fractions into high-performance carbon fibers.

Description of Related Art

The "background" description provided herein is for the purpose of generally presenting the context of the disclosure. The work of the presently named inventors, to the extent it is described in this background section, as well as aspects of the description which may not otherwise qualify as prior art at the time of filing, are neither expressly nor impliedly admitted as prior art against the present invention.

With the sustained rise in global energy demand, the petrochemical industry has seen an increased dependence on unconventional petroleum feedstocks such as oilsands, shale oil, heavy oil, bitumen, and vacuum residue. The unconventional petroleum feedstocks, when processed, yield heavy petroleum fractions that are chemically and physically recalcitrant due to their elevated molecular weights, low hydrogen-to-carbon ratios, and inherent chemical complexity. Furthermore, the heavy petroleum fractions are frequently rich in heteroatoms such as sulfur, nitrogen, and heavy metals, and often contain persistent free radicals that exacerbate difficulties in processing, transportation, and storage.

One of the most intractable components of heavy petroleum fractions is asphaltenes. Asphaltenes are complex aromatic structures characterized by low solubility and high thermal stability [See: Alili, A. S.; Siddiquee, M. N.; De Klerk, A. *Origin of free radical persistence in asphaltenes: cage effect and steric protection Energy and Fuels* 2020, 34

(1), 348-359]. Despite challenging properties, asphaltenes have garnered significant interest in the scientific community as promising precursors for producing high-strength, lightweight carbon fibers [See: Nguyen, M. T.; Nguyen, D. L. T.; Xia, C.; Nguyen, T. B.; Shokouhimehr, M.; Sana, S. S.; Grace, A. N.; Aghbashlo, M.; Tabatabaei, M.; Sonne, C.; Kim, S. Y.; Lam, S. S.; Le, Q. Van. *recent advances in asphaltene transformation in heavy oil hydroprocessing: progress, challenges, and future perspectives Fuel Processing Technology* 2021, 213, 106681]. Carbon fibres produced from these precursors are gaining growing attention in the aerospace, automotive, military, and infrastructure industries for their exceptional mechanical strength and resistance to corrosion.

Conventionally, carbon fibres are manufactured from polyacrylonitrile (PAN), which, although effective, imposes significant economic and environmental burdens owing to its high production cost and limited recyclability. Accordingly, interest has turned toward alternate precursor streams derived from lower-cost, petroleum-based materials, particularly heavy hydrocarbon. These approaches seek to harness the inherent aromaticity and high carbon yield of such fractions, provided they can be suitably processed.

Various methods have been reported to enhance the utility of heavy hydrocarbon fractions for carbon fiber precursor applications. Notably, oxidative treatment of heavy vacuum gas oil (HVGO) under elevated temperatures to alter its physical and chemical properties [See: Kamkar, M.; Natale, G. *A review on novel applications of asphaltenes Fuel* 2021, 285]. In particular, efforts have been made to modulate oxygen availability and mixing conditions to achieve partial oxidation of HVGO. While changes in viscosity and softening point indicative of product transformation have been reported, these approaches have largely failed to isolate or utilize asphaltenes from HVGO for downstream fiber formation [See: Zhao, Q.; Sun, Q.; Xin, S.; Chen, Y.; Wu, C.; Wang, H.; Xu, J.; Wan, M.; Zeng, W.; Zhao, Y. *High-Strength titanium alloys for aerospace engineering applications: a review on melting-forging process. materials science and engineering Materials Science and Engineering: A* 2022, 845, 143260]. Furthermore, the investigations have not addressed the chemical contribution of naphthenic-aromatic hydrocarbons in facilitating addition reactions or enhancing the structural integrity of resultant oxidation products.

The absence of systematic strategies for separating and utilizing oxidized asphaltenes from HVGO remains a substantial limitation in the art. Moreover, the inability to fabricate continuous green filaments or carbonized fibres directly from HVGO-based oxidation products underscores the inadequacy of current methodologies in translating such materials to high-performance fiber applications [See: Zuo, P.; Leistenschneider, D.; Kim, Y.; Ivey, D. G.; Chen, W. *The Effect. of thermal pretreatment temperature on the diameters and mechanical properties of asphaltene-derived carbon fibres Journal of Materials Science* 2021, 56 (27), 14964-14977]. In particular, prior techniques fail to address the molecular selectivity, thermal processing conditions, and chemical transformations required for generating stable, spinnable precursors that can be effectively converted into carbon.

Hence, there exists a requirement for an industrially viable method that enables the conversion of heavy vacuum gas oil into structured asphaltenes suitable for carbon fiber formation. Accordingly, one object of the present disclosure is to provide method of forming a carbon fiber via heat treating a heavy vacuum gas oil, that may circumvent the above specified drawbacks and limitation of the methods known in the art.

SUMMARY

In an exemplary embodiment, a method of forming a carbon fiber is described. The method includes heat treating a heavy vacuum gas oil at a heat treatment temperature of 125 to 225° C. with a gas mixture including oxygen to form an oxidized HVGO. The method further includes collecting asphaltenes from the oxidized HVGO followed by melt spinning the asphaltenes to form a raw filament. The method further includes treating the raw filament with a mineral acid to form an acid-treated filament and then oxidizing the acid-treated filament by heating the acid-treated filament in air at a temperature of 125 to 175° C. to form an oxidized filament. The method further includes carbonizing the oxidized filament by heating the oxidized filament under an inert atmosphere at a temperature of 700 to 900° C. to form the carbon fiber.

In some embodiments, the heat treatment is performed at a heat treatment temperature of 150 to 190° C.

In some embodiments, the heavy vacuum gas oil is substantially free of asphaltenes.

In some embodiments, the heavy vacuum gas oil includes 35 to 50 wt. % saturates, 45 to 60 wt. % aromatics and 2.5 to 10 wt. % resins, each based on a total weight of heavy vacuum gas oil.

In some embodiments, the heavy vacuum gas oil includes 80 to 90 wt. % carbon, 7.5 to 15 wt. % hydrogen, 1 to 5 wt. % sulfur; and 0.1 to 1 wt. % oxygen, each based on a total weight of heavy vacuum gas oil.

In some embodiments, the heat treating involves bubbling the gas mixture through the heavy vacuum gas oil without mixing.

In some embodiments, the heat treating involves bubbling the gas mixture through the heavy vacuum gas oil with mixing.

In some embodiments, the mixing is performed at 50 to 500 rpm.

In some embodiments, the heavy vacuum gas oil is a tetralin-supplemented heavy vacuum gas oil including 1 to 30 wt. % tetralin, based on a total weight of tetralin-supplemented heavy vacuum gas oil.

In some embodiments, the oxidized HVGO includes 12.5 to 57.5 wt. % asphaltenes, based on a total weight of oxidized HVGO.

In some embodiments, the oxidized HVGO has a viscosity at 25° C. of 1 to 125 Pa·s.

In some embodiments, the melt spinning is performed at a temperature of 210 to 270° C. and a spinning rate of 250 to 550 rpm.

In some embodiments, the mineral acid is nitric acid.

In some embodiments, the nitric acid has a concentration of 30 to 50 wt % in water.

In some embodiments, the raw filament has a mean diameter of 25 to 125 μm.

In some embodiments, the raw filament has a hydrogen to carbon atomic ratio of 0.90 to 1.15.

In some embodiments, the raw filament has a softening point of 175 to 225° C.

In some embodiments, the carbon fiber has a mean diameter of 15 to 75 μm.

In some embodiments, the collecting asphaltenes is performed by solvent precipitation.

In some embodiments, the solvent is n-heptane.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
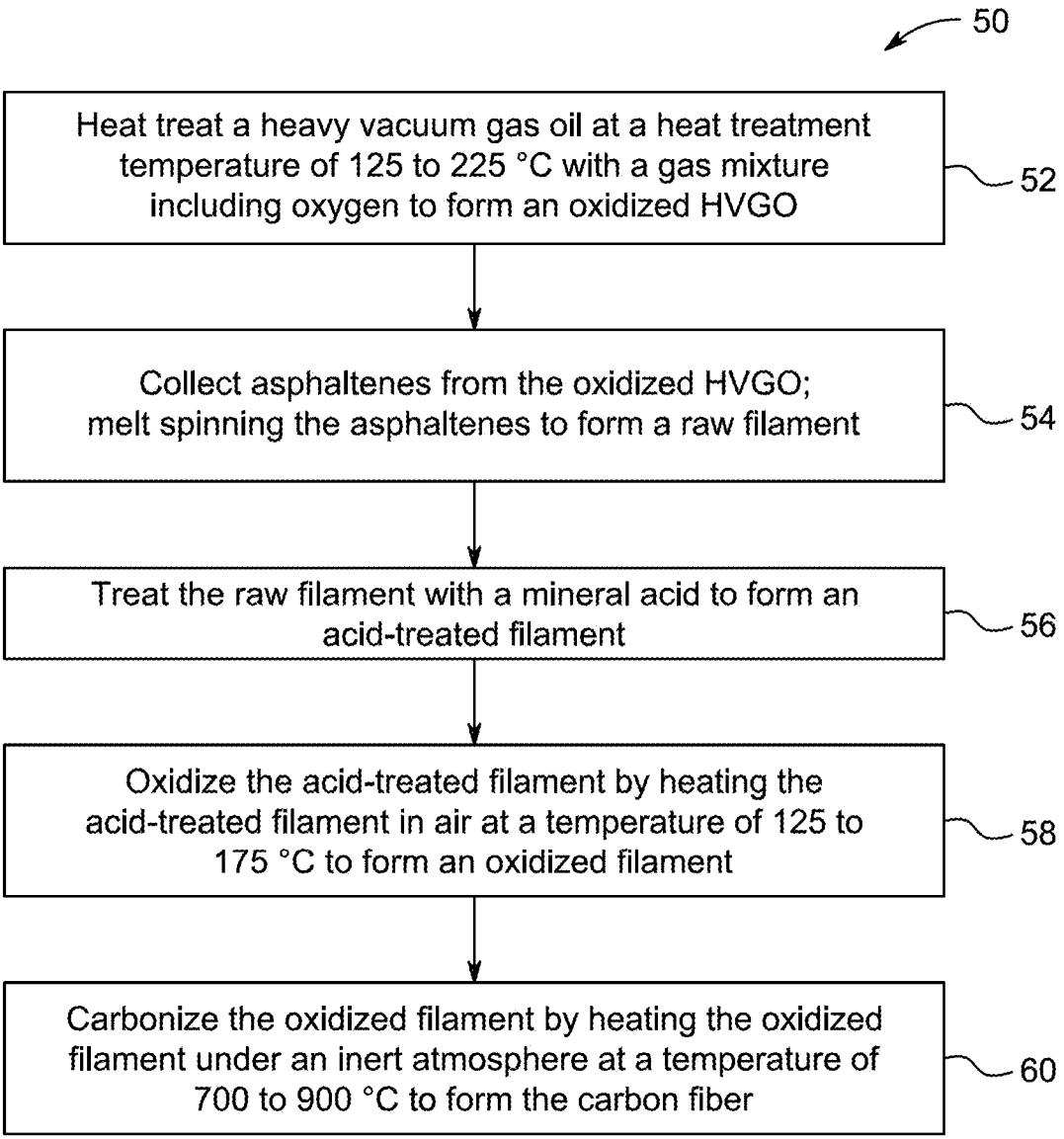
FIG. 1A is an exemplary flow chart of a method of forming a carbon fibre via heavy vacuum gas oil (HVGO), according to certain embodiments.

In the drawings, reference numerals designate identical or corresponding parts throughout the several views. Further, as used herein, the words 'a,' 'an' and the like generally carry a meaning of 'one or more,' unless stated otherwise.

When describing the present disclosure, the terms used are to be construed in accordance with the following definitions, unless a context dictates otherwise.

Embodiments of the present invention will now be described more fully hereinafter with reference to the accompanying drawings wherever applicable, in that some, but not all, embodiments of the disclosure are shown.

In the drawings, like reference numerals designate identical or corresponding parts throughout the several views. Further, as used herein, the words 'a,' 'an' and the like generally carry a meaning of 'one or more,' unless stated otherwise.

Furthermore, the terms 'approximately,' 'approximate,' 'about,' and similar terms generally refer to ranges that include the identified value within a margin of 20%, 10%, or preferably 5%, and any values therebetween.

As used herein, the term 'room temperature' refers to a temperature range of '25 degrees Celsius (° C.)±3° C. in the present disclosure.

As used herein, the term 'carbon fiber' refers to a lightweight, high-strength material composed primarily of carbon atoms arranged in a crystalline structure, typically produced through the thermal decomposition of organic precursors, and used in various structural, thermal, and electrical applications.

As used herein, the term 'heavy vacuum gas oil' refers to a high-boiling fraction obtained from the vacuum distillation of crude oil, typically comprising complex hydrocarbons with high molecular weights and serving as a feedstock for further refining or conversion processes.

As used herein, the term 'oxidized HVGO' refers to a heavy vacuum gas oil that has undergone a controlled oxidation process, resulting in chemical and physical modifications such as increased asphaltenes content, viscosity, and softening point, making it suitable for use as a carbon fiber precursor.

As used herein, the term 'solvent precipitation' refers to a separation technique in which specific solvents are added to a mixture to selectively precipitate components such as asphaltenes based on their solubility differences.

As used herein, the term 'viscosity' refers to a measure of a fluid's resistance to flow, indicating its internal friction and thickness under specific conditions.

As used herein, the term 'melt spinning' refers to a fiber-forming process in which a molten material is extruded through a spinneret and solidified by cooling to form continuous filaments.

As used herein, the term 'acid-treated filament' refers to a fiber that has been subjected to an acid treatment process to modify its surface properties, remove impurities, or enhance its structural characteristics for further processing or end-use applications.

As used herein, the term 'softening point' refers to a specific temperature at which a material, such as oxidized heavy vacuum gas oil or asphaltenes, begins to soften and flow under defined conditions, indicating its thermal transition from a solid-like to a more pliable or semi-liquid state.

As used herein, the term 'mean diameter' refers to a statistically averaged measurement of the thickness or width of a filament or fiber, typically expressed in micrometers (μm), calculated from multiple individual diameter values to represent the overall size distribution of the sample.

A weight percent of a component, unless specifically stated to the contrary, is based on the total weight of the formulation or composition in which the component is included. For example, if a particular element or component in a composition or article is said to have 5 wt. %, it is understood that this percentage is in relation to a total compositional percentage of 100%.

The present disclosure is intended to include all hydration states of a given compound or formula, unless otherwise noted or when heating a material.

An aspect of the present disclosure relates to a method for producing carbon fiber from heavy vacuum gas oil (HVGO) through controlled autoxidation, facilitated by precise oxygen management and reactive additives.

FIG. 1A illustrates a schematic flow chart of a method 50 of forming a carbon fiber. The order in which the method 50 is described is not intended to be construed as a limitation, and any number of the described method steps can be combined to implement the method 50. Additionally, individual steps may be removed or skipped from the method 50 without departing from the spirit and scope of the present disclosure.

At step 52, the method 50 involves heat treating a heavy vacuum gas oil at a heat treatment temperature of 125 to 225° C. with a gas mixture including oxygen to form an oxidized HVGO. In some embodiments, the heat treatment is carried out at a temperature ranging from 125 to 225° C., preferably 150 to 190° C., preferably 170 to 225° C., preferably 200 to 225° C., preferably 210 to 225° C., preferably 220 to 225° C. In a preferred embodiment, the heat treatment is performed at a temperature of 160 and 190° C. In some embodiments, the heat treating involves bubbling the gas mixture through the heavy vacuum gas oil with or without mixing. In a preferred embodiment, the heat treatment involves bubbling the gas mixture through the heavy vacuum gas oil without or with mixing. The heat treating involves bubbling a gas mixture through the heavy vacuum gas oil (HVGO) to facilitate enhanced contact between the gas and liquid phases, thereby promoting efficient oxygen diffusion and uniform autoxidation throughout the medium. This bubbling action helps initiate and sustain oxidative reactions needed for increasing the asphaltenes content and modifying the rheological and chemical properties of HVGO for carbon fiber precursor development. In some embodiments, this step is carried on via mixing at 50 to 500 rpm, preferably 100 to 500 rpm, preferably 200 to 500 rpm, preferably 300 to 500 rpm, preferably 400 to 500 rpm. In a preferred embodiment, the mixing is performed at 200 rpm.

In some embodiments, the heavy vacuum gas oil includes 35 to 50 wt. %, preferably 37 to 50 wt. %, preferably 40 to 50 wt. %, preferably 45 to 50 wt. %, preferably 47 to 50 wt. % saturates, based on the total weight of heavy vacuum gas oil. In a preferred embodiment, the heavy vacuum gas oil includes 42.91 wt. % saturates, based on the total weight of heavy vacuum gas oil. In some embodiments, the heavy vacuum gas oil includes 45 to 60 wt. %, preferably 50 to 60 wt. %, preferably 52 to 60 wt. %, preferably 55 to 60 wt. %, preferably 57 to 60 wt. % aromatics, based on the total weight of heavy vacuum gas oil. In a preferred embodiment, the heavy vacuum gas oil includes 51.18 wt. % aromatics, based on a total weight of heavy vacuum gas oil. In some embodiments, the heavy vacuum gas oil includes 2.5 to 10 wt. %, preferably 5 to 10 wt. %, preferably 7.5 to 10 wt. %, preferably 9 to 10 wt. % resins, based on a total weight of heavy vacuum gas oil. In a preferred embodiment, the heavy vacuum gas oil includes 5.91 wt. % resins, based on a total weight of heavy vacuum gas oil. In a preferred embodiment, the heavy vacuum gas oil is substantially free of asphaltenes.

In a preferred embodiment, oxidized HVGO includes asphaltenes. In some embodiments, the oxidized HVGO includes 12.5 to 57.5 wt. %, preferably 15 to 57 wt. %, preferably 20 to 57 wt. %, preferably 30 to 57 wt. %, preferably 40 to 57 wt. %, preferably 50 to 57 wt. % asphaltenes, based on a total weight of oxidized HVGO. In a preferred embodiment, the oxidized HVGO includes 47.2 wt. % asphaltenes, based on the total weight of oxidized HVGO.

In some embodiments, the oxidized HVGO has a viscosity at 25° C. ranging from 1 to 125 Pa·s, preferably 10 to 125 Pa·s, preferably 50 to 125 Pa·s, preferably 70 to 125 Pa·s, preferably 90 to 125 Pa·s, preferably 100 to 125 Pa·s, preferably 120 to 125 Pa·s. In a preferred embodiment, the oxidized HVGO has a viscosity at 25° C. of 23.15 Pa·s bubbling with mixing and 117.6 Pa·s bubbling without mixing. In one embodiment, the oxidized HVGO has a viscosity at 25° C. of 7.959 Pa·s.

In some embodiments, the heavy vacuum gas oil includes 80 to 90 wt. %, preferably 82 to 90 wt. %, preferably 84 to 90 wt. %, preferably 86 to 90 wt. %, preferably 88 to 90 wt. % carbon, based on a total weight of heavy vacuum gas oil. In a preferred embodiment, the heavy vacuum gas oil includes 85.3 wt. % carbon, based on the total weight of heavy vacuum gas oil. In some embodiments, the heavy vacuum gas oil includes 7.5 to 15 wt. %, preferably 9 to 15 wt. %, preferably 11 to 15 wt. %, preferably 13 to 15 wt. % hydrogen, based on the total weight of heavy vacuum gas oil. In a preferred embodiment, the heavy vacuum gas oil includes 11.9 wt. % hydrogen, based on the total weight of heavy vacuum gas oil. In some embodiments, the heavy vacuum gas oil includes 1 to 5 wt. %, preferably 2 to 5 wt. %, preferably 3 to 5 wt. %, preferably 4 to 5 wt. % sulfur, based on a total weight of heavy vacuum gas oil. In a preferred embodiment, the heavy vacuum gas oil includes 2.3 wt. % sulfur, based on the total weight of heavy vacuum gas oil.

In some embodiments, the heavy vacuum gas oil includes 0.1 to 1 wt. %, preferably 0.2 to 1 wt. %, preferably 0.4 to 1 wt. %, preferably 0.6 to 1 wt. %, preferably 0.8 to 1 wt. % oxygen, based on the total weight of heavy vacuum gas oil. In a preferred embodiment, the heavy vacuum gas oil includes 0.4 wt. % oxygen, based on the total weight of heavy vacuum gas oil. In some embodiments, the heavy vacuum gas oil includes 0.1 to 1 wt. %, preferably 0.2 to 1 wt. %, preferably 0.4 to 1 wt. %, preferably 0.6 to 1 wt. %, preferably 0.8 to 1 wt. % nitrogen, based on a total weight of heavy vacuum gas oil. In a preferred embodiment, the heavy vacuum gas oil includes 0.1 wt. % nitrogen, based on the total weight of heavy vacuum gas oil.

In some embodiment, the heavy vacuum gas oil is a tetralin-supplemented heavy vacuum gas oil including 1 to 30 wt. %, preferably 5 to 30 wt. %, preferably 10 to 30 wt. %, preferably 15 to 30 wt. %, preferably 20 to 30 wt. %, preferably 25 to 30 wt. %, preferably 28 to 30 wt. % tetralin, based on the total weight of tetralin-supplemented heavy vacuum gas oil.

At step 54, the method 50 involves collecting asphaltenes from the oxidized HVGO. In some embodiments, the asphaltenes may be collected by techniques such as filtration, centrifugation, adsorption, membrane separation, thermal precipitation, electrostatic separation, ultrafiltration, microfiltration, size exclusion chromatography, field-flow fractionation, freeze-drying, cloud point extraction, solid-phase extraction, electrocoagulation, nanofiltration, magnetic separation, gel permeation chromatography, foam fractionation, hydrodynamic cavitation, molecular sieving, acoustic separation, cryogenic fractionation, vacuum distillation, sedimentation, ion exchange, mechanical screening, microwave-assisted separation, thermal evaporation, and selective flocculation. In a preferred embodiment, the asphaltenes may be collected by solvent precipitation.

In some embodiments, solvent may include but is not limited to toluene, benzene, xylene, dichloromethane, chloroform, carbon tetrachloride, methanol, ethanol, isopropanol, butanol, acetone, acetonitrile, dimethylformamide, dimethyl sulfoxide, tetrahydrofuran, diethyl ether, ethyl acetate, methyl tert-butyl ether, cyclohexane, hexane, octane, dodecane, pentane, propylene carbonate, formamide, 1,4-dioxane, nitromethane, anisole, trichloroethylene, and chlorobenzene. In a preferred embodiment, the solvent is n-heptane.

At step 56, the method 50 involves melt spinning the asphaltenes to form a raw filament. In some embodiments, the melt spinning is performed at a temperature ranging from 210 to 270° C., preferably 220 to 270° C., preferably 230 to 270° C., preferably 240 to 270° C., preferably 250 to 270° C., preferably 260 to 270° C. In a preferred embodiment, the melt spinning is performed at a temperature of 240° C. In some embodiments, a spinning rate ranging from 250 to 550 rpm, preferably 300 to 550 rpm, preferably 350 to 550 rpm, preferably 400 to 550 rpm, preferably 450 to 550 rpm, preferably 500 to 550 rpm, more preferably about 400 rpm, is maintained during the melt spinning process.

At step 58, the method 50 involves treating the raw filament with a mineral acid to form an acid-treated filament. In some embodiments, mineral acid may include but are not limited to hydrochloric acid, sulfuric acid, hydrobromic acid, hydroiodic acid, phosphoric acid, perchloric acid, chloric acid, hypochlorous acid, hydrofluoric acid, boric acid, chromic acid, hydrocyanic acid, selenic acid, telluric acid, arsenic acid, arsenous acid, antimonic acid, antimonous acid, silicic acid, vanadic acid, molybdic acid, tungstic acid, periodic acid, iodic acid, bromic acid, chlorous acid, perbromic acid, permanganic acid, manganic acid, and plumbic acid. In a preferred embodiment, the mineral acid is nitric acid. In some embodiments, nitric acid has a concentration of 30 to 50 wt %, preferably 32 to 50 wt %, preferably 35 to 50 wt %, preferably 40 to 50 wt %, preferably 42 to 50 wt %, preferably 45 to 50 wt %, preferably 48 to 50 wt % in water.

In some embodiments, the raw filament has a mean diameter ranging from 25 to 125 μm, preferably 50 to 125 μm, preferably 70 to 125 μm, preferably 90 to 125 μm, preferably 100 to 125 μm, preferably 110 to 125 μm, preferably 120 to 125 μm. In a preferred embodiment, the raw filament has a mean diameter of 70 μm. In some embodiments, the raw filament has a hydrogen to carbon atomic ratio ranging from 0.90 to 1.15, preferably 0.95 to 1.15, preferably 1.0 to 1.15, preferably 1.1 to 1.15. In a preferred embodiment, hydrogen to carbon atomic ratio is 1.04. In one embodiment, hydrogen to carbon atomic ratio is 1.5.

In some embodiments, the raw filament has a softening point ranging from 175 to 225° C., preferably 190 to 225° C., preferably 200 to 225° C., preferably 210 to 225° C., preferably 220 to 225° C. In a preferred embodiment, the raw filament has a softening point of 210° C.

At step 60, the method 50 involves oxidizing the acid-treated filament by heating the acid-treated filament in air at a temperature of 125 to 175° C. to form an oxidized filament. In some embodiments, heating is performed at a temperature ranging from 125 to 175° C., preferably 130 to 175° C., preferably 140 to 175° C., preferably 150 to 175° C., preferably 160 to 175° C., preferably 170 to 175° C., preferably at about 150° C.

At step 62, the method 50 involves carbonizing the oxidized filament by heating the oxidized filament under an inert atmosphere at a temperature of 700 to 900° C. to form the carbon fiber. In some embodiments, heating is performed at a temperature ranging from 700 to 900° C., preferably 750 to 900° C., preferably 800 to 900° C., preferably 850 to 900° C. In a preferred embodiment, heating is performed under an inert atmosphere at a temperature of 800° C. In some embodiments, inert atmosphere may include but is not limited to argon, helium, neon, krypton, xenon, radon, carbon dioxide, sulfur hexafluoride, methane, ethane, propane, butane, isobutane, and hydrogen (in controlled conditions). In a preferred embodiment, an inert atmosphere is obtained by nitrogen gas.

In some embodiments, the carbon fiber has a mean diameter ranging from 15 to 75 μm, preferably 20 to 75 μm, preferably 40 to 75 μm, preferably 50 to 75 μm, preferably 60 to 75 μm, preferably 70 to 75 μm. In a preferred embodiment, the carbon fiber has a mean diameter of 70 μm.

EXAMPLES

The following examples demonstrate a method of forming carbon fiber including heat treating a heavy vacuum gas oil. The examples are provided solely for illustration and are not to be construed as limitations of the present disclosure, as many variations thereof are possible without departing from the spirit and scope of the present disclosure.

Example 1: Materials

According to the present disclosure, heavy vacuum gas oil (HVGO) was sourced from a local source in Saudi Arabia. In order to limit exposure to light and prevent reactions that may accelerate oxidation, the raw material was kept in sealed containers in a dark environment. The precaution was necessary to minimize photooxidation, where light and oxygen promote free radical reactions. Table 1 provides a detailed composition and property overview of the raw HVGO. The saturates, aromatics, resins, and asphaltenes (SARA) fraction analysis indicates that the raw feed primarily consists of saturates (42.91 wt. %), aromatics (51.18 wt. %), and resins (5.90 wt. %), with no asphaltenes present. The elemental analysis shows high carbon (85.3 wt. %) and hydrogen (11.9 wt. %) content, with minimal oxygen (0.4 wt. %) and nitrogen (0.1 wt. %). The viscosity of the feed was measured at both 25° C. (2.854 Pa·s) and 40° C. (0.730 Pa·s). The density of HVGO is 1120 kg/m$^3$, and the softening point was recorded at 37° C.

TABLE 1

Composition and properties of Raw-HVGO.
Property

| SARA fractions | (wt. %) |
|---|---|
| Saturates | 42.91 |
| Aromatics | 51.18 |
| Resins | 5.90 |
| Asphaltenes | 0 |
| **Elemental analysis** | **(wt. %)** |
| Carbon | 85.3 |
| Hydrogen | 11.9 |
| Nitrogen | 0.1 |
| Oxygen [a] | 0.4 |
| Sulfur | 2.3 |
| Viscosity, Pa · s[b]. | 2.85 ± 0.11 |
| Viscosity, Pa · s[c]. | 0.73 ± 0.01 |
| Density, kg/m$^3$ | 1120 |
| Softening Point, ° C. | 37 |

[a] Content was obtained by the difference.
[b]Measured at 25° C. and average of 10 different values ± one standard deviation of a single sample.
[c]Measured at 40° C. and average of 10 different values ± one standard deviation of a single sample.

The cylinder gases used for the autoxidation reactions were ultra-high-purity nitrogen (99.999% purity) supplied by Air Liquide Al Khafrah Ind. Gases and compressed zero air by Saudi Industrial Gas Company. Chloroform (≥99.8%, Honeywell), acetone (≥99.8%, Sigma-Aldrich), toluene (≥99.7%, Honeywell), hydrochloric acid (36%, Honeywell), sulfuric acid (98%, Honeywell), and/or nitric acid (86%, Honeywell) were used in some cases, especially for high-temperature and longer-term experiments, to remove the stain from the glassware after the experiments. Furthermore, 99.7% benzene and 99.9% carbon disulfide from Honeywell were utilised in dissolving the samples for analyses such as Fourier transform infrared spectroscopy (FTIR).

Example 2: Equipment Setup and Autoxidation

Figure 1B:
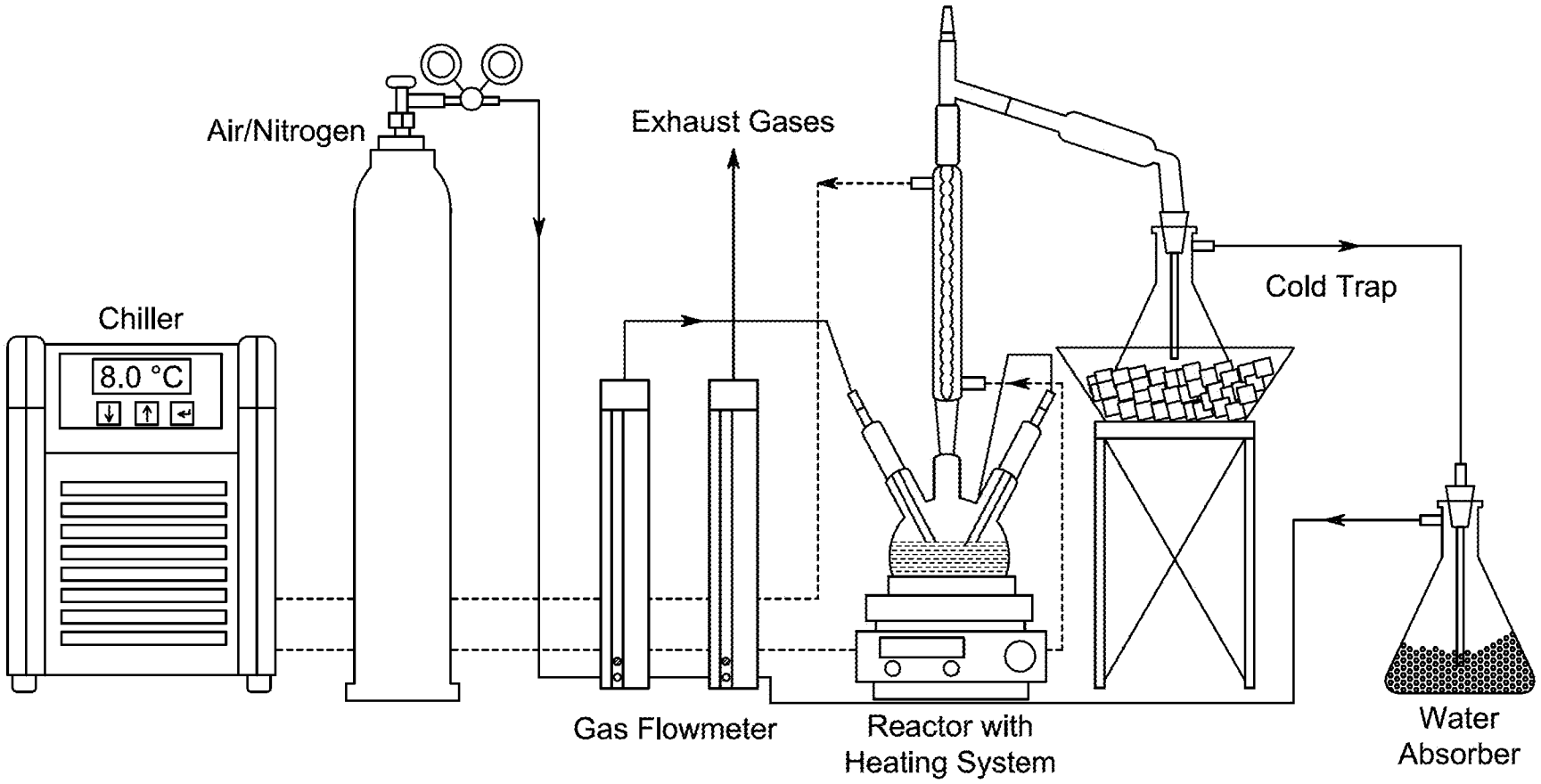
FIG. 1B illustrates a schematic representation of an experimental setup utilized for the autoxidation of heavy vacuum gas oil (HVGO), according to certain embodiments.

Raw industrial feed was autoxidized using the equipment shown in FIG. 1B. A Pyrex 250 milliliters (mL) round-bottom flask was used which had three-necks, first for air inlet, second for volatile vapors outlet and third for thermocouple. The temperature and mixing in the flask were regulated using a Heidolph MR Hei-Standard heat-on-block heater including a magnetic stirring system, fixed at 200 revolutions per minute (rpm). A gas flow meter, PMR 1-010977, Aalborg Instrument, USA, was used to adjust the airflow rate to 152 mL/min into the petroleum fractions from a compressed air cylinder. The volatile vapors from the second opening of flask were rapidly condensed in a borosilicate glass coil condenser with the help of cooling water at 8° C.

For each experiment, approximately 50 g of HVGO was loaded into the flask and heated to the desired temperature of about 160° C. to 190° C., using the heat-on-block system, and a small amount of silicone oil was applied to improve contact between the glass and metal surfaces. Tetralin was added to the HVGO in varying concentrations from 0 wt. % to 30 wt. %, and once the target temperature was achieved, the air supply was opened. Stirring continued at 200 rpm to ensure effective mixing, as the viscosity of the HVGO at reaction temperatures was sufficiently low. Reaction times were set between 24 hours and 96 hours. After the completion of the experiment, the air supply was shut off, the apparatus was disassembled, and the final product was weighed to check the mass balance.

Example 3: Melt Spinning

Melt spinning of the oxidized HVGO and oxidized HVGO-derived asphaltenes samples were conducted using a melt-spinning machine (Model No. AT225) to produce "green fibers." A monofilament spinneret with a 150 μm diameter was utilized for the procedure. Approximately 10 grams (g) of HVGO and oxidized HVGO-derived asphaltenes were placed into the cylindrical heating chamber, which was further sealed. The material was heated until the material reached a melting point, and a $N_2$ pressure was increased to 250 kilopascals (kPa) to assess whether filaments emerge from the spinneret. If no filament formed, the temperature was incrementally raised by 10° C., and the $N_2$ pressure was adjusted accordingly. The foregoing process continued until filaments were successfully produced. Once filament formation began, the winding process started at a speed of 200 rpm to 500 rpm by engaging the cycloid mechanism, aligning the polymer chains, and winding the filaments onto spools.

Example 4: Acid Treatment

In order to activate the surface of green carbon fiber, the acid treatment was performed. In this process, the green carbon fiber was immersed in a 40% $HNO_3$ solution. The experiment was performed for 20 minutes at room temperature. After acid treatment, the oxidative stabilization and carbonization of the treated sample were conducted using a compact split tube furnace (OTF-1200X-S50). The tube was made of quartz material with an outer diameter of 5 cm, a 4.4 cm inner diameter, and 60 cm in length.

Example 5: Oxidative Stabilization

In order to prevent material fusion and sustain the material structure at higher temperatures, the treated green fiber was oxidized. During the experiment, the air flow rate was set at 150 mL/min. The following procedure has been adopted to perform the experimental run, the procedure includes a first step where acid-treated green fibers were kept inside the alumina crucible, and the crucible was placed amidst a tube in the furnace. A second step included setting the program for the oxidization (in air gas) as: 0 to 150° C. with an increase of 3° C./min, hold for 10 minutes at 150° C., 150° C. to 300° C. with an increase of 5° C./min, hold for 24 hours at 300° C., cooling from 300° C. to 150° C. at a rate of about 5° C./min, and from 150° C. to 20° C. at a rate of about 3° C./min. A third step of the procedure included pulling the crucible was with the help of long wire after cooling down the furnace, and the resulting carbon fiber was used for carbonization purposes.

Example 6: Carbonization

In order to avoid oxidation at higher temperatures to produce stabilized commercial carbon fiber, the heteroatoms present in the structure of carbon fiber were eliminated using carbonization. Further, to avoid the oxidation of carbon fiber, an inert environment was maintained throughout the experiment, where the nitrogen gas flow rate was kept fixed at 150 mL/min. The following procedure was adopted to perform the experimental run, where the first step of the procedure included keeping the oxidized fibers inside the alumina crucible, and the alumina crucible was placed in the middle of the furnace tube. A second step included setting the program for the carbonization (in $N_2$ gas) as: 0 to 450° C. where the rate of temperature increase was about 10° C./min, hold for 10 minutes at 450° C., 450 to 800° C. where the rate of temperature increase was about 5° C./min, hold for 30 minutes at 800° C., and cooling from 800° C. to 450° C. at a rate of about 5° C./min, furthermore, cooling up to 20° C. at a rate of about 10° C./min. A third step of the procedure included pulling out the crucible with the help of a long wire after cooling down the furnace, and the resulting carbon fiber was used for further analysis.

Example 7: Analyses

According to the present disclosure, a SARA analysis was performed. In particular, the weight percentage of saturates, aromatics, resins, and asphaltenes was computed using a combination of solvents and chromatography techniques. The sample was dissolved in a non-polar solvent such as n-heptane, causing the asphaltenes to precipitate out. The remaining solution was then passed through a chromatographic column, where saturates were first eluted with n-heptane. Aromatics were extracted with a slightly polar solvent such as hexane, and resins were eluted with a more polar solvent such as toluene. The isolated fractions were then quantified, providing insights into the composition of the sample.

Further, elemental analysis was conducted on the sample. In particular, a PerkinElmer 2400, USA instrument was employed for the determination of weight percentage of carbon (C), hydrogen (H), nitrogen (N), and sulfur (S), elemental analyzer. The oxygen content was estimated using the difference formula.

Furthermore, the viscosity of the sample was measured using a Discovery HR-3 hybrid rheometer (TA, USA) instrument. Viscosity was measured at 40° C., which was raised from 25° C. at a rate of 5° C./min under a constant shear rate of 10 $s^{-1}$. A peak hold phase followed, with measurements taken at 40° C. for a duration of 10 minutes, including a 3-minute soaking period. The sampling interval was set to 10 seconds per point. After the analysis, the instrument was cooled down to 25° C.

Moreover, the density of the raw HVGO was determined manually by calculating the mass-to-volume ratio. A parafilm, measuring 50×50×0.12 mm, was used to wrap an unknown amount of HVGO, which was then fully submerged in a 25 mL glass cylinder containing water initially filled to the 10 mL mark. Approximately 8 mL of water was displaced. The mass of the HVGO before and after wrapping in the parafilm was measured using a digital scale, and the values were recorded in grams.

In addition, to measure the softening point of both VR and product samples, about 15-20 g of pre-heated material was filled in a metallic ring and allowed to cool down in a refrigerator at about −5° C. for at least 30 minutes. Any additional protruding material after freezing was scrubbed off by a sharp, flat, thin plate. Softening points were recorded by using both a manual ball-and-ring in a medium of glycerin, and a softmatic automatic ring and ball having model number B070N2 (50/60 Hz, 800 W) by MATEST S.p.A, Treviolo, 24048 Italy.

In addition, thermogravimetric analysis was performed to evaluate thermal stability and to understand the extent of cross-linking, which led to a high molecular weight heavy (addition) product. Approximately 10 g of selected samples was examined in an SDT Q600 V20.9 Build 20 thermogravimetric analyzer (TGA) coupled with a differential scanning calorimeter (DSC). An alumina pan was used for both the reference and the samples. A nitrogen flow rate of 50 mL/min was maintained during the analysis, and the temperature was programmed from 30 to 950° C. with a ramp setting of 10° C./min.

The surface morphology of the carbon fibres was characterized using a field emission scanning electron microscope (FESEM) (Quattro S, Massachusetts, USA), operated at an accelerating voltage in the range of approximately 200 kV to 30 kV. The FESEM was equipped with an energy-dispersive X-ray (EDX) detector configured to capture elemental X-ray signals, and a low vacuum detector (LVD) for low vacuum secondary electron imaging. Beam deceleration was facilitated using a stage bias ranging from approximately ~4000 V to +50 V.

Further, attenuated total reflection-Fourier transform infrared (ATR-FTIR) spectroscopy was employed to analyse the functional groups present in the sample. Approximately 1 gram of each sample was transferred into a 4 mL glass vial, and an aliquot of each sample was independently examined using a Nicolet iS50 FT-IR spectrometer. The spectral acquisition was conducted in transmission mode, and absorbance spectra were additionally recorded in absorption mode to confirm spectral features.

The autoxidation of HVGO is a chemically driven transformation governed by a free radical mechanism, where the availability and diffusion of oxygen constitute vital parameters influencing the kinetics of reaction, extent of conversion, and the selectivity of resultant products. Naphthenic-aromatic hydrocarbons, by virtue of molecular structure thereof, are predisposed to the formation of comparatively stable free radicals, and as such, play a significant role in modulating the autoxidation pathway under varied oxidative environments. In certain embodiments, the influence of naphthenic-aromatic hydrocarbons on the autoxidation behavior of HVGO was examined under two distinct oxygen delivery modalities, namely, bubbling of oxygenated gas with continuous mixing, and surface-level blowing of oxygenated gas without mixing. Variations in these oxygen introduction methods were observed to induce measurable effects on multiple physicochemical parameters of the HVGO, including but not limited to asphaltenes content, viscosity, volatility, softening point, and the extent of formation of high molecular weight heavy-end products.

Further, asphaltenes represent the most chemically complex fraction within petroleum-derived materials and are primarily composed of high molecular weight polyaromatic hydrocarbons. The constituents are typically concentrated in the heaviest portions of crude oil and are characterized by distinct solubility behavior; specifically, asphaltenes are insoluble in low molecular weight alkanes such as n-heptane or pentane, while remaining soluble in aromatic solvents such as toluene. In certain embodiments, the variation in asphaltenes content in HVGO was examined under differing oxidative treatment conditions, including two temperature regimes, namely approximately 160° C. and 190° C., and under the two distinct oxygen delivery methods bubbling of air with continuous mixing, and surface blowing of air without mixing. Experimental results, as summarized in Table 2 and illustrated in FIGS. 2A-2B, demonstrate the effect of these variables on the formation and accumulation of asphaltenes in the oxidized HVGO matrix.

TABLE 2

A summary of the change in asphaltenes content, viscosity, and softening point during HVGO autoxidation in the presence of tetralin at different operating condisitons.

| Air addition method | Experiment ID | Tetralin conc. % w/w | Time (h) | Temperature (° C.) | Asphaltenes content (wt. %) [a] | Viscosity at 25° C. (Pa · s) [b] | Softening point (° C.) [a] |
|---|---|---|---|---|---|---|---|
| Bubbling with mixing | A | 0 | 24 | 160 | 8.7 | 4.77 ± 0.20 | — |
| | B | 0 | 24 | 190 | 9.8 | 6.49 ± 0.31 | — |
| | C | 5 | 24 | 160 | 2.5 | 4.66 ± 0.27 | — |
| | D | 5 | 24 | 190 | 7 | 5.57 ± 0.28 | — |
| | E | 10 | 24 | 160 | 2.7 | 1.98 ± 0.12 | — |
| | F | 10 | 24 | 190 | 9.1 | 4.39 ± 0.22 | — |
| | G | 20 | 24 | 160 | 4.2 | 1.2 ± 0.05 | — |
| | H | 20 | 24 | 190 | 8.7 | 1.48 ± 0.07 | — |
| | I | 30 | 24 | 160 | 3.6 | 0.40 ± 0.01 | — |
| | J | 30 | 24 | 190 | 14.7 | 0.68 ± 0.02 | — |
| | K | 0 | 48 | 190 | 15.9 | 19.9 ± 1.3 | 52.2 |
| | L | 5 | 48 | 190 | 17.9 | 23.15 ± 1.4 | 58.6 |
| Blowing without mixing | M | 0 | 24 | 160 | 1.5 | 3.13 ± 0.16 | — |
| | N | 0 | 24 | 190 | 12.4 | 10.8 ± 0.63 | — |
| | O | 5 | 24 | 160 | 2.4 | 2.73 ± 0.15 | — |
| | P | 5 | 24 | 190 | 5.7 | 3.69 ± 0.28 | 48.3 |
| | Q | 10 | 24 | 160 | 1.6 | 1.03 ± 0.04 | — |
| | R | 10 | 24 | 190 | 8.1 | 3.25 ± 0.17 | — |
| | S | 0 | 48 | 190 | 17.1 | 26.7 ± 1.9 | 57.6 |
| | T | 5 | 48 | 190 | 32.8 | 51.5 ± 8.9 | 145 |

TABLE 2-continued

A summary of the change in asphaltenes content, viscosity, and softening point during HVGO autoxidation in the presence of tetralin at different operating condisitons.

| Air addition method | Experiment ID | Tetralin conc. % w/w | Time (h) | Temperature (° C.) | Asphaltenes content (wt. %) [a] | Viscosity at 25° C. (Pa · s) [b] | Softening point (° C.) [a] |
|---|---|---|---|---|---|---|---|
| | U | 0 | 72 | 190 | 39.8 | 80.8 ± 20.6 | 165 |
| | V | 5 | 72 | 190 | 47.2 | 117.6 ± 58 | 210 |

As illustrated in Table 2, the asphaltenes content observed across the experimental conditions varied significantly as a function of the air introduction method, tetralin concentration, and applied oxidation temperature. In the case of air bubbling with mixing, the asphaltenes content ranged from approximately 2.5 wt. % to 14.7 wt. %, with a general trend of increasing asphaltenes content observed at higher temperatures, such as 190° C., particularly in the presence of elevated tetralin concentrations up to 30 wt. % (such as, Experiment J). Conversely, experiments employing the blowing of air without mixing demonstrated a broader range in asphaltenes yield, with pronounced increases correlating with extended oxidation durations and elevated thermal conditions. The highest recorded asphaltenes content was approximately 47.2 wt. % under conditions of 72-hour oxidation at 190° C. with 5 wt. % tetralin (Experiment V), underscoring the combined influence of prolonged reaction time and restricted oxygen availability.

Figure 2A:
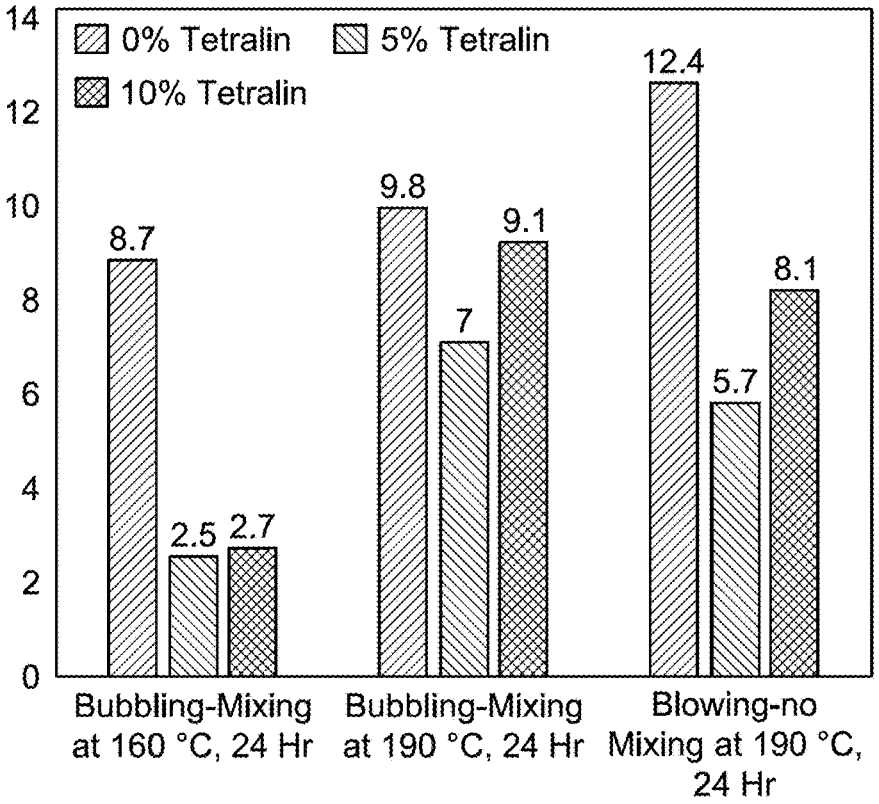
FIG. 2A illustrates the variation in asphaltenes content during HVGO autoxidation in the presence of tetralin, at temperatures ranging from 160° C. to 190° C., over a duration of 24 hours under different air introduction methods, according to certain embodiments.

FIG. 2A depicts the relationship between tetralin concentration and asphaltenes formation under both bubbling with mixing and blowing without mixing conditions. At an oxidation temperature of approximately 160° C., a decreasing trend in asphaltenes content was noted with increasing tetralin concentration in the bubbling configuration. For instance, in the absence of tetralin (Experiment A), the asphaltenes content was 8.7 wt. %, which decreased to approximately 2.7 wt. % at 10 wt. % tetralin (Experiment E). In contrast, for the blowing without mixing condition at 160° C. and a reaction time of 24 hours (Experiment M), the asphaltenes content was measured at 1.5 wt. %, with minimal variation upon increasing tetralin concentration.

At 190° C., the behaviour shifted notably. Under bubbling with mixing conditions (Experiment C), asphaltenes content initially declined to 2.5 wt. % at 5 wt. % tetralin, but subsequently rose sharply to 14.7 wt. % at 30 wt. % tetralin (Experiment J). In the blowing without mixing configuration at the same temperature (Experiment N), asphaltenes content remained consistently higher, with a maximum of 12.4 wt. % observed in the absence of tetralin, followed by a slight decline with increasing tetralin concentration.

Figure 2B:
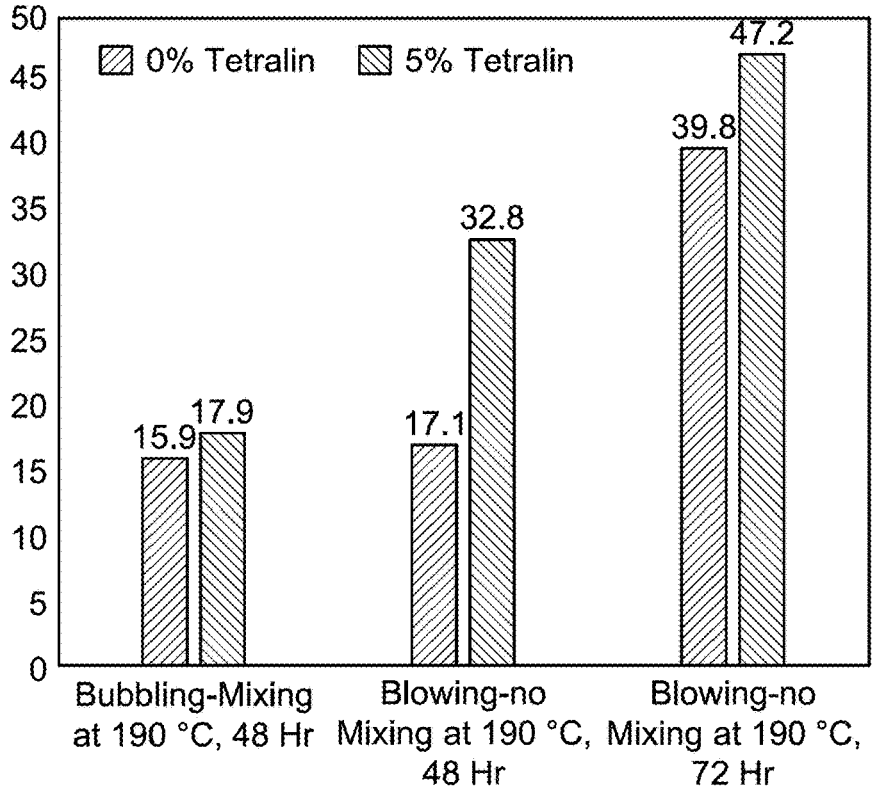
FIG. 2B illustrates the change in asphaltenes content during HVGO autoxidation in the presence of tetralin, at 190° C., over extended durations of 48 to 72 hours under different air introduction methods, according to certain embodiments.

FIG. 2B highlights the effect of extended oxidation durations at 190° C. under the blowing without mixing condition. At 48 hours, asphaltenes content showed marked variation based on tetralin concentration. Without tetralin, a content of 17.1 wt. % was recorded (Experiment S), while the addition of 5 wt. % tetralin increased this value to 32.8 wt. % (Experiment T). Under similar thermal and temporal conditions with bubbling and mixing (Experiments K and L), asphaltenes content remained comparatively lower, measuring at 15.9 wt. % and 17.9 wt. %, respectively. Upon further extension of the oxidation time to 72 hours, the disparity became more pronounced. In the blowing without mixing configuration, asphaltenes content rose substantially to 47.2 wt. % with 5 wt. % tetralin (Experiment V), whereas the corresponding value without tetralin (Experiment U) was recorded at 39.8 wt. %.

For oxidation conditions not explicitly depicted in FIG. 2A or FIG. 2B, such as those involving higher concentrations of tetralin under the bubbling with mixing configuration, the data presented in Table 2 offers additional insights into asphaltenes formation. At an oxidation temperature of approximately 160° C., the asphaltenes content was observed to decrease progressively with increasing tetralin concentration under bubbling conditions. Specifically, at 20 wt. % tetralin, the asphaltenes content declined to approximately 4.2 wt. % (Experiment G), and further decreased to 3.6 wt. % at 30 wt. % tetralin (Experiment I). At 190° C., the asphaltenes content measured under similar conditions increased from 8.7 wt. % at 20 wt. % tetralin (Experiment H) to 14.7 wt. % at 30 wt. % tetralin (Experiment J), reflecting a temperature-dependent reversal in trend.

In summary, the highest recorded asphaltenes content of approximately 47.2 wt. % was achieved under the blowing without mixing configuration at 190° C. for a duration of 72 hours with 5 wt. % tetralin (Experiment V). Further, the lowest content of approximately 1.5 wt. % was observed under the same air addition method at 160° C. in the absence of tetralin (Experiment M).

Figure 3A:
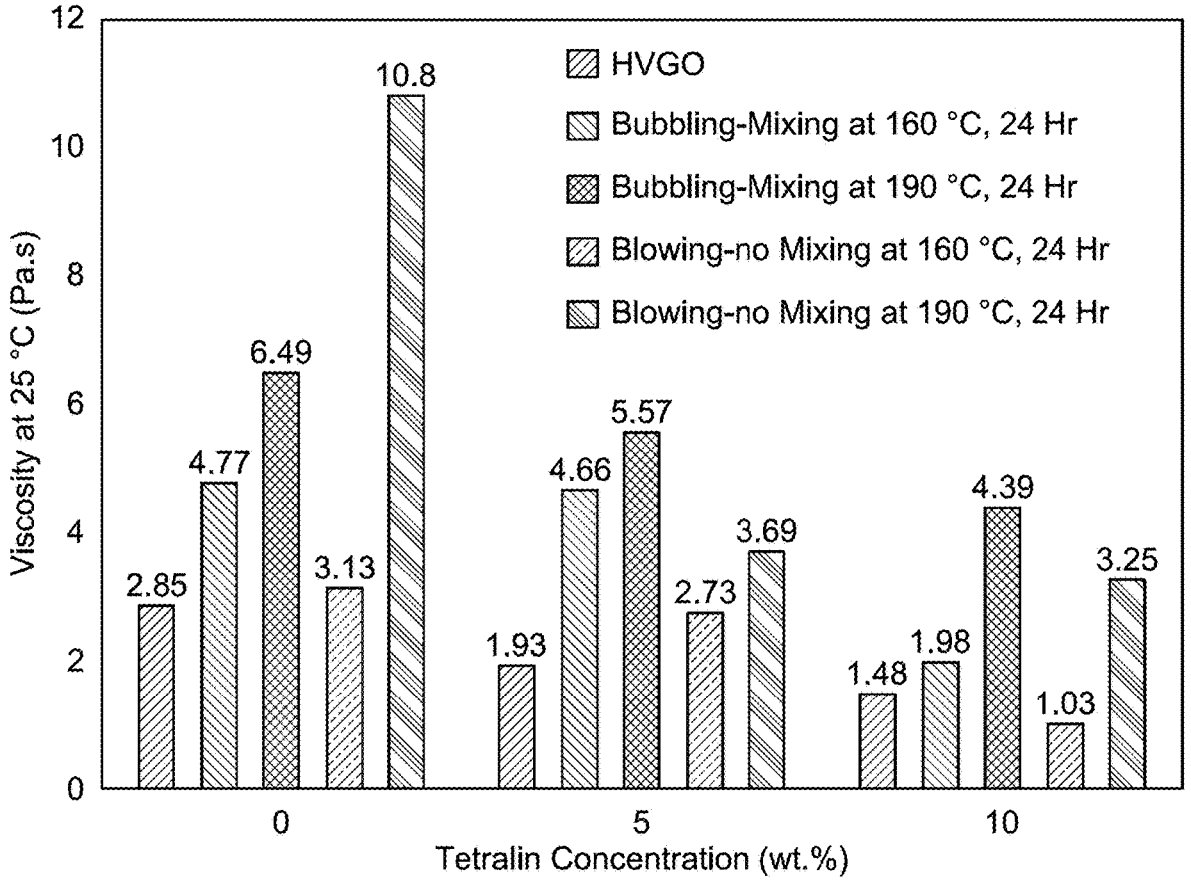
FIG. 3A illustrates the changes in viscosity of HVGO samples subjected to autoxidation for 24 hours under varying conditions, according to certain embodiments.
Figure 3B:
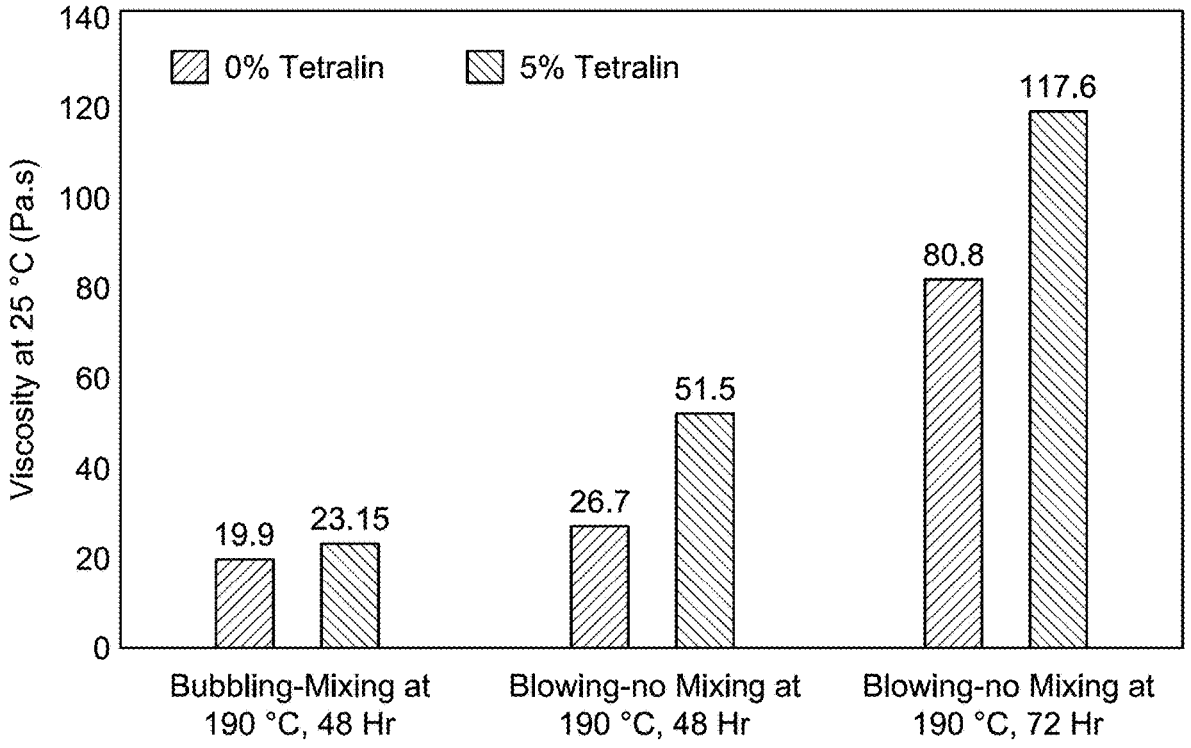
FIG. 3B illustrates the changes in viscosity of HVGO samples subjected to extended autoxidation durations beyond 24 hours, according to certain embodiments.

In general, viscosity constitutes a vital physical property that undergoes substantial modification during the autoxidation of heavy vacuum gas oil (HVGO). The variation in viscosity as a function of oxygen introduction method, tetralin concentration, and reaction temperature is illustrated in FIGS. 3A-3B. The influence of oxidative conditions specifically temperature, mixing strategy, and additive concentration on the rheological behaviour of HVGO is shown in FIGS. 3A-3B and Table 2. In particular, at an oxidation temperature of approximately 160° C., FIG. 3A indicates that the bubbling with mixing method yielded comparatively lower viscosity values across all tetralin concentrations. For example, the viscosity of the sample subjected to 0 wt. % tetralin under this configuration (Experiment A) was approximately 4.77 Pa·s, which decreased significantly to about 1.93 Pa·s at 10 wt. % tetralin (Experiment E). By contrast, under the blowing without mixing condition at 160° C., a modest increase in viscosity was observed with increasing tetralin concentration. The viscosity value at 0 wt. % tetralin (Experiment M) was measured at approximately 3.13 Pa·s, whereas at 10 wt. % tetralin (Experiment Q), the viscosity decreased to approximately 1.03 Pa·s.

Further, at an oxidation temperature of approximately 190° C., the viscosity behaviour exhibited increased complexity, as illustrated in FIG. 3A. Under the air bubbling with mixing configuration, the viscosity of HVGO remained relatively controlled across various tetralin concentrations. For instance, in the absence of tetralin (Experiment B), the viscosity was measured at approximately 6.49 Pa·s, which decreased to 4.39 Pa·s at 10 wt. % tetralin (Experiment F).

As indicated in Table 2, further increases in tetralin concentration led to additional reductions in viscosity, with a value of approximately 0.68 Pa·s observed at 30 wt. % tetralin (Experiment J).

In contrast, the blowing without mixing condition at 190° C. resulted in a substantial increase in viscosity with increasing tetralin concentration and extended oxidation time. For example, viscosity values of approximately 10.8 Pa·s and 2.73 Pa·s were recorded at 0 wt. % tetralin (Experiment N) and 5 wt. % tetralin (Experiment O), respectively.

FIG. 3B illustrates the influence of oxidation duration on viscosity under the blowing without mixing configuration at 190° C. After 48 hours of oxidation, viscosity values rose markedly, reaching approximately 51.5 Pa·s at 0 wt. % tetralin (Experiment T) and 26.7 Pa·s at 5 wt. % tetralin (Experiment S). Upon extending the oxidation time to 72 hours, viscosity increased substantially to 117.6 Pa·s in the presence of 5 wt. % tetralin (Experiment V), while a viscosity of 80.8 Pa·s was recorded at 0 wt. % tetralin (Experiment U).

For higher tetralin concentrations not explicitly depicted in FIG. 3A or 3B, including 20 wt. % and 30 wt. % under the bubbling with mixing method, the data presented in Table 2 provide further insights. At 160° C. with 20 wt. % tetralin, viscosity was reduced to approximately 1.48 Pa·s (Experiment H), and at 30 wt. % tetralin, it further decreased to 0.40 Pa·s (Experiment I). Similarly, at 190° C. with 30 wt. % tetralin, the viscosity reached a minimum value of approximately 0.68 Pa·s (Experiment J).

Among the experimental conditions evaluated, the highest viscosity values were recorded under the blowing without mixing configuration at an oxidation temperature of approximately 190° C. Specifically, after 72 hours of oxidation, the viscosity of the sample treated with 5 wt. % tetralin (Experiment V) reached approximately 117.6 Pa·s, whereas the corresponding sample without tetralin (Experiment U) exhibited a viscosity of approximately 35.4 Pa·s. Additionally, at a 48-hour oxidation duration, the viscosity under the same blowing without mixing condition measured approximately 51.5 Pa·s with 5 wt. % tetralin (Experiment T), and 26.7 Pa·s with 0 wt. % tetralin (Experiment S). The foregoing results collectively illustrate the pronounced influence of extended oxidation time and restricted oxygen mixing on the enhancement of HVGO viscosity, and are indicative of the progressive formation of higher molecular weight oxidation products under such conditions.

In general, the softening point serves as an important thermal property indicative of the degree of oxidation and the formation of high molecular weight species within oxidized heavy vacuum gas oil (HVGO). The softening point of unmodified, or raw, HVGO is approximately 37° C., as referenced in Table 1, and is herein utilized as a baseline for evaluating changes induced by various oxidative treatment conditions as detailed in Table 2. At an oxidation temperature of approximately 190° C. and a reaction duration of 48 hours, the softening point exhibited a moderate elevation under the bubbling with mixing configuration. Specifically, the softening point increased to approximately 52.2° C. in the absence of tetralin (Experiment K) and to 58.6° C. with 5 wt. % tetralin (Experiment L). In contrast, under the blowing without mixing configuration at the same temperature, the increase in softening point was substantially more pronounced. For instance, after 24 hours of oxidation, the softening point was measured at approximately 48.3° C. in the absence of tetralin (Experiment N). However, under identical thermal and temporal conditions with the addition of 5 wt. % tetralin, the softening point increased markedly to 174° C. (Experiment T).

The trend of accelerated thermal transformation became even more evident with extended oxidation time under the blowing without mixing method at 190° C. After 72 hours of oxidation, the softening point of the sample without tetralin (Experiment U) increased significantly to 165° C., while the corresponding sample with 5 wt. % tetralin (Experiment V) demonstrated an extraordinarily high softening point of approximately 210° C. The foregoing results underscore the synergistic effect of prolonged oxidation time and limited oxygen dispersion on the evolution of thermally stable, high-softening-point materials suitable for downstream thermal processing applications.

Thermogravimetric analysis (TGA) was conducted to assess the thermal stability of heavy vacuum gas oil (HVGO) and oxidation products generated under varying reaction conditions. The TGA results revealed that raw HVGO exhibited the lowest thermal stability, as evidenced by an early onset of mass loss, which is indicative of the presence of low molecular weight, volatile components.

In contrast, samples subjected to oxidative treatment demonstrated progressively enhanced thermal stability, particularly under the blowing without mixing configuration at elevated temperatures. For example, when HVGO was oxidized at approximately 190° C. for 48 hours in the presence of 5 wt. % tetralin (Experiment T), the TGA profile exhibited a delayed onset of decomposition, indicating the formation of higher molecular weight and thermally more stable oxidation products. Further extension of the oxidation duration to 72 hours under the same thermal conditions, but in the absence of tetralin (Experiment U), resulted in an additional improvement in thermal stability, attributed to the prolonged residence time facilitating the formation of heavier compounds with greater resistance to thermal degradation. The highest degree of thermal stability was observed in the sample oxidized at 190° C. for 72 hours with 5 wt. % tetralin (Experiment V). The TGA curve for this condition closely approximated the thermal behaviour of isolated asphaltenes, which are known to resist decomposition at elevated temperatures. The trend emphasizes the synergistic effect of tetralin addition and extended oxidation time in producing thermally resilient oxidation products, which exhibit characteristics suitable for use as carbon fiber precursors.

Figure 4:
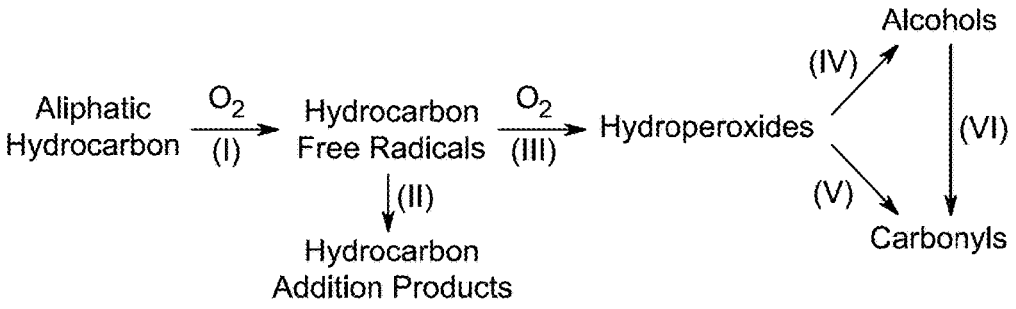
FIG. 4 illustrates the overall reaction network associated with the autoxidation of aliphatic hydrocarbons, according to certain embodiments.

Autoxidation refers to a chemically controlled oxidative process wherein hydrocarbons undergo reaction with molecular oxygen at comparatively low temperatures. Distinct from combustion, autoxidation occurs under kinetically moderated conditions that suppress rapid exothermic behaviour, enabling a gradual oxidative transformation of hydrocarbon substrates. Such controlled reaction environments are important for investigating the molecular evolution of heavy vacuum gas oil (HVGO) components under the experimental conditions described herein. The reaction mechanism of aliphatic hydrocarbon autoxidation, as outlined in FIG. 4, includes multiple sequential steps involving free radical intermediates. Initially, aliphatic hydrocarbons react with molecular oxygen to yield hydrocarbon free radicals. Under oxygen-limited conditions, these radicals may combine with adjacent hydrocarbons to form addition products (Step II). Alternatively, in the presence of excess oxygen, the radicals proceed to generate hydroperoxides (Step III), which serve as thermally unstable intermediates. Hydroperoxides may subsequently decompose to produce alcohols (Step IV) or undergo further oxidation to yield carbonyl-containing species (Step V), such as aldehydes and ketones. In certain instances, alcohols themselves may participate in secondary oxidation pathways, contributing further to molecular complexity.

Figure 5:
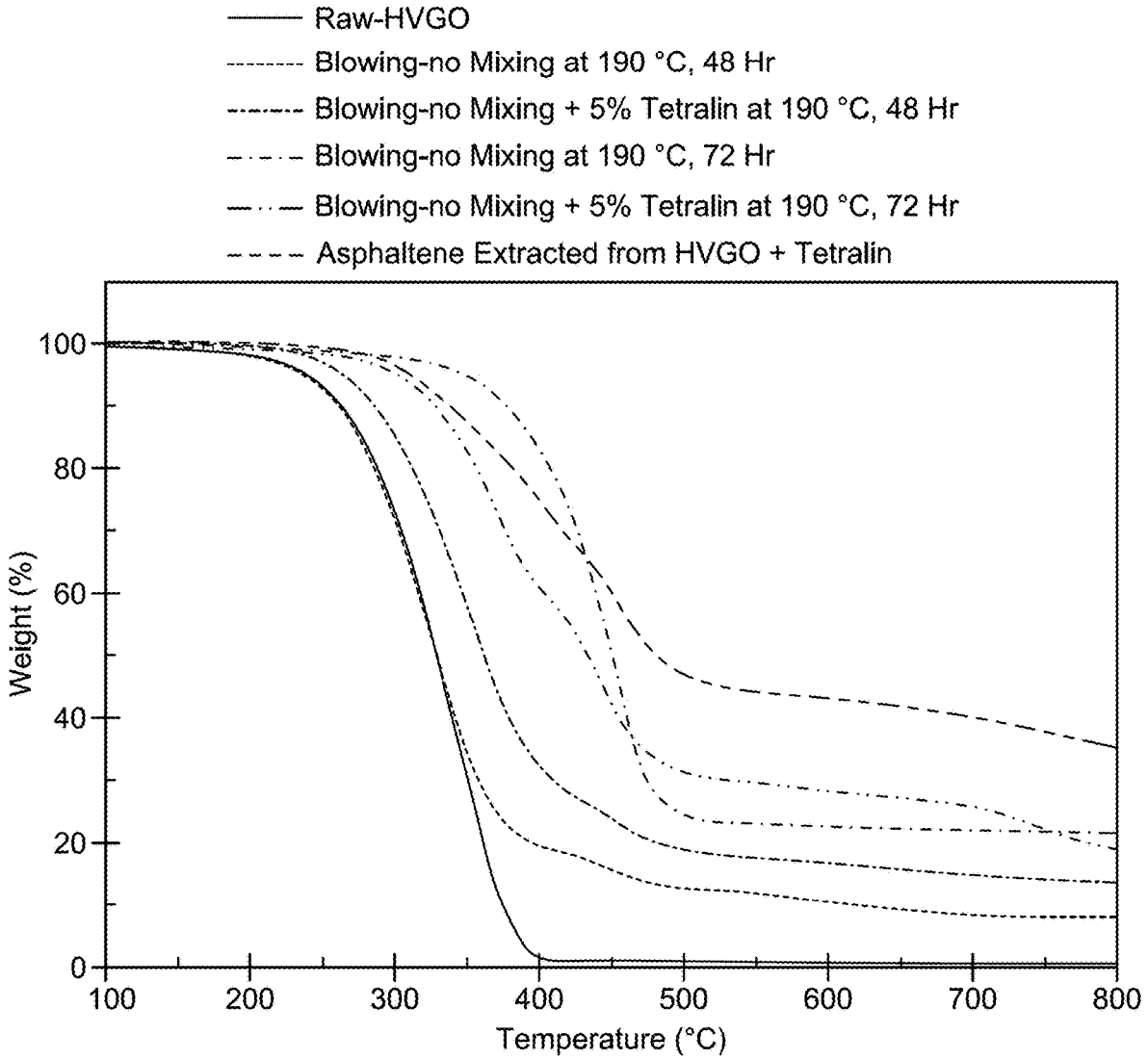
FIG. 5 illustrates thermogravimetric analysis (TGA) thermograms for raw and oxidized HVGO samples subjected to different operating conditions, according to certain embodiments.

Within the compositional matrix of HVGO, the primary constituents susceptible to autoxidation are cyclic saturated hydrocarbons and naphthenic-aromatic hydrocarbons. In contrast, linear and branched alkanes, along with non-naphthenic aromatic compounds, demonstrate lower reactivity under identical conditions due to their relatively stronger C—H bonds and enhanced molecular stability. Accordingly, autoxidation of HVGO under the conditions disclosed herein primarily targets the cyclic and naphthenic-aromatic fractions. The generation of hydrocarbon free radicals during autoxidation is highly sensitive to temperature. As the reaction temperature increases, the rate of radical formation accelerates, increasing the probability of forming heavy-end addition products under oxygen-limited conditions. The aforesaid mechanistic pathway corresponds with experimentally observed increases in asphaltenes content and viscosity at elevated temperatures and extended reaction times, as reflected in FIG. 2A and FIG. 3A, respectively. Additionally, the prolonged oxidative exposure intensifies the extent of free radical propagation, contributing to the formation of heavier, less volatile molecular species. The aforesaid effects are corroborated by higher asphaltenes content (FIG. 2B), increased viscosity (FIG. 3B), elevated softening points (Table 2), and enhanced thermal stability profiles, as shown in FIG. 5.

In view of the above, consideration must be given to the method of air introduction employed during the autoxidation process. Specifically, the distinction between air bubbling with mixing and air blowing without mixing has a significant impact on oxidation kinetics and product distribution, even when temperature is held constant. The operational variables govern the diffusion and reactivity of oxygen within the system and influence the structural transformation and resultant physicochemical properties of oxidized HVGO.

As previously established, HVGO inherently results in an increase in asphaltenes content. However, the extent and efficiency of this transformation are further influenced by the method of oxygen delivery employed during the oxidation process. In the air bubbling with mixing configuration, mechanical agitation facilitates uniform dispersion of oxygen throughout the entire reaction volume. This homogeneous distribution enables a consistent and controlled oxidation reaction across the bulk HVGO matrix.

Conversely, the air blowing without mixing method introduces oxygen only at the surface interface between the gaseous phase and the HVGO liquid phase. In the absence of agitation, oxygen is not dispersed throughout the bulk, resulting in a relatively lower overall oxygen availability. However, constrained oxygen exposure promotes the preferential formation of addition products via stepwise radical-driven reactions at the gas-liquid interface, corresponding to Step II in FIG. 6. Under these conditions, free radicals generated at the interface engage in sequential addition reactions, leading to the progressive accumulation of higher molecular weight compounds. The heavier products further descend due to gravitational settling, permitting unoxidized lighter HVGO components to migrate to the surface and undergo subsequent oxidation. The aforementioned ordered and spatially localized mechanism enables the formation of high molecular weight species in a more consistent and controlled fashion. By contrast, the enhanced oxygen availability associated with the air bubbling with mixing method increases the likelihood of the reaction following Step III in FIG. 6, leading to the generation of hydroperoxide intermediates. The intermediates, while reactive, may contribute to less selective and more heterogeneous product distributions due to their propensity for uncontrolled decomposition and chain branching.

The practical implications of the aforementioned mechanistic differences are reflected in the experimental data summarized in Table 2. For instance, at an oxidation temperature of 190° C. and a duration of 24 hours, Experiment N (air blowing without mixing) resulted in an asphaltenes content of approximately 12.4 wt. %, while Experiment B (air bubbling with mixing) under identical thermal and temporal conditions yielded an asphaltenes content of approximately 9.8 wt. %. The higher yield under the blowing configuration supports the hypothesis that controlled, interfacial oxidation enables more effective formation of heavy-end products under conditions of limited oxygen transfer.

However, at a lower temperature of 160° C., the oxidation efficiency of the two methods is reversed. Under 24-hour oxidation at 160° C., Experiment A (bubbling with mixing) produced an asphaltenes content of approximately 8.7 wt. %, compared to only 1.5 wt. % for Experiment M (blowing without mixing). The disparity is attributed to reduced free radical formation at lower temperatures, particularly under surface-limited oxidation conditions. In the absence of vigorous mixing, the restricted oxygen interaction with the HVGO bulk results in a suppressed oxidation rate. In contrast, bubbling with mixing ensures that oxygen reaches all reactive sites within the bulk, enabling more uniform oxidative conversion even under less thermally favourable conditions.

The results collectively highlight the role of the air addition strategy in determining the progression and extent of HVGO autoxidation. The spatial distribution and availability of molecular oxygen directly modulate the predominant reaction pathways, the efficiency of asphaltenes formation, and the resultant physicochemical properties of the oxidized product stream. The influence of tetralin in further modulating these effects under analogous oxidative environments is addressed in the subsequent section.

Moving further, tetralin, a naphthenic aromatic hydrocarbon, plays a vital and role in the autoxidation of HVGO due to an inherent susceptibility of tetralin to oxidative transformation. Among the molecular constituents of HVGO, tetralin exhibits a relatively higher reactivity owing to the lability of benzylic hydrogen atoms and a tendency of tetralin to form stabilized free radical intermediates. Under specific reaction conditions, tetralin has been observed to undergo partial oxidation, resulting in the formation of dark-coloured, high molecular weight products. Such products have previously been correlated with increases in both viscosity and density, as reported in prior experimental investigations.

The oxidative transformation of tetralin is highly sensitive to the prevailing oxygen availability in the reaction environment. As illustrated in FIG. 7, under conditions of high oxygen concentration, such as those encountered during air bubbling with mixing, tetralin undergoes oxidation pathways that predominantly yield oxygenated products including alcohols and ketones. By contrast, under oxygen-limited conditions, such as those characteristics of air blowing without mixing, tetralin favours addition-type reactions. In general, the addition products are more desirable within the context of modifying HVGO properties, particularly when aiming to enhance asphaltenes formation and thermal stability, as depicted in FIG. 6.

Mechanistically, the autoxidation of tetralin begins with hydrogen abstraction at the α-position (Structure A), leading to the formation of a resonance-stabilized free radical intermediate (Structure B). In an oxygen-limited environment, the aforesaid free radical is more likely to engage in addition reactions with reactive intermediates present in the HVGO matrix. Conversely, in an oxygen-rich environment, the free radical may react with molecular oxygen to yield peroxyl radicals, which in turn produce oxygenated species such as alcohols and ketones, as outlined in FIG. 7.

Figure 6:
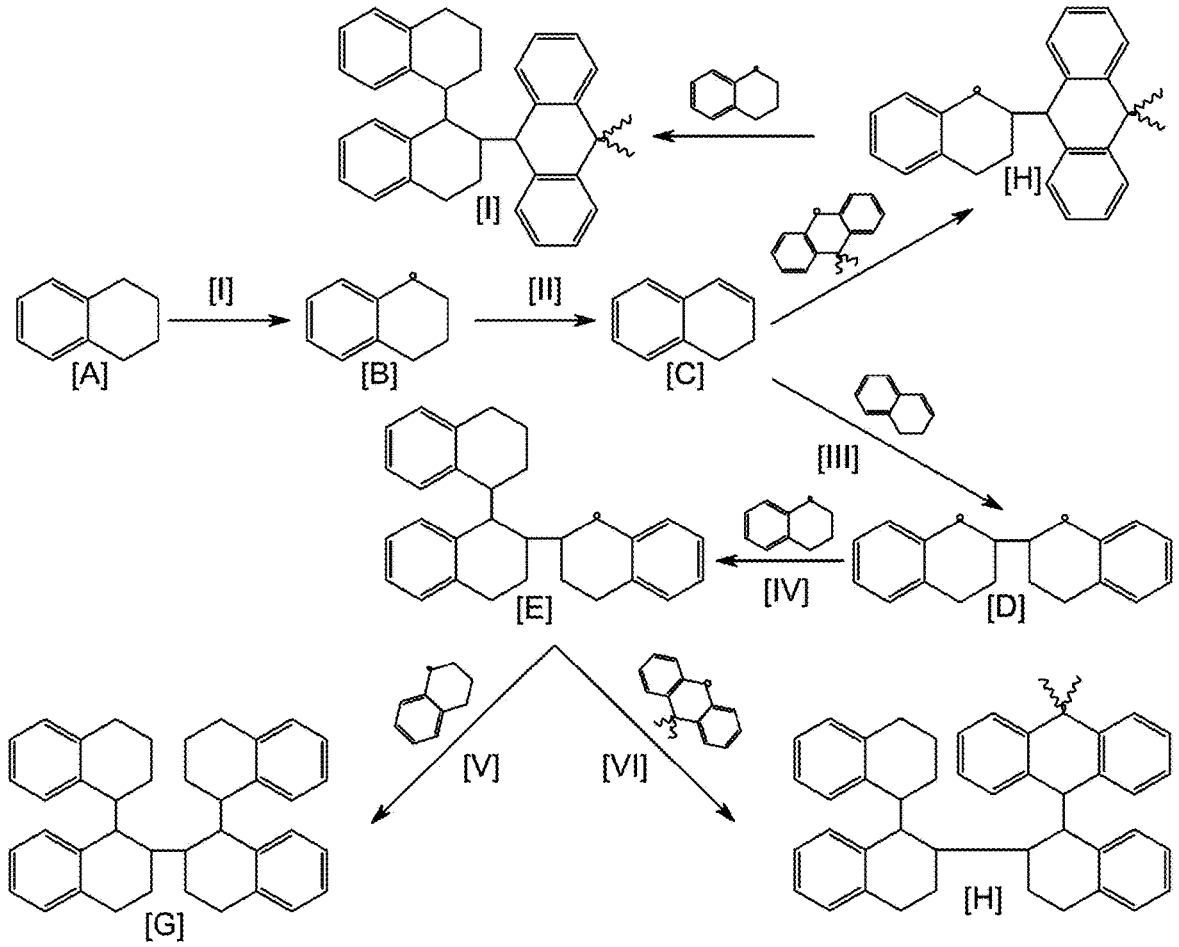
FIG. 6 illustrates a typical potential addition reaction occurring during the autoxidation of HVGO in the presence of a naphthenic aromatic hydrocarbon under conditions of low oxygen availability, according to certain embodiments.
Figure 7:
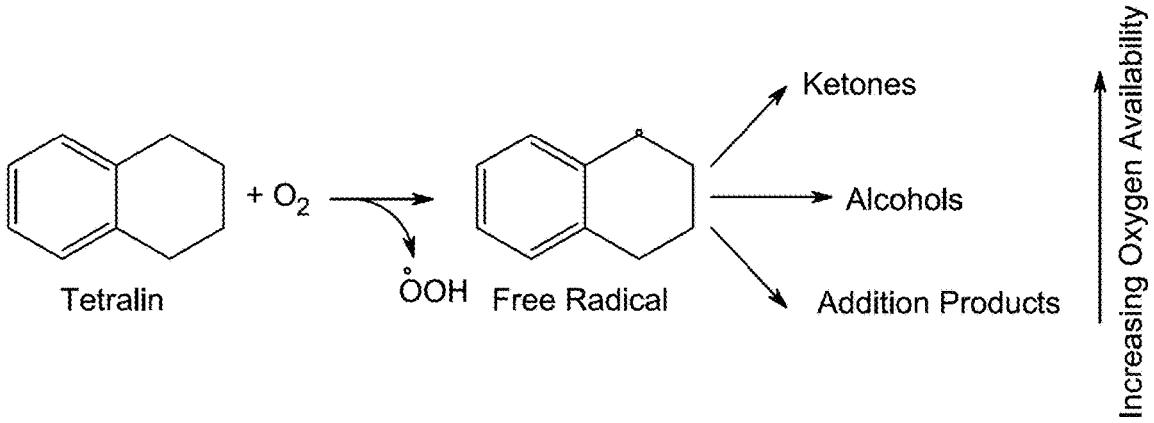
FIG. 7 illustrates the oxidation pathway of tetralin under varying oxygen availability conditions, according to certain embodiments.
Figure 8A:
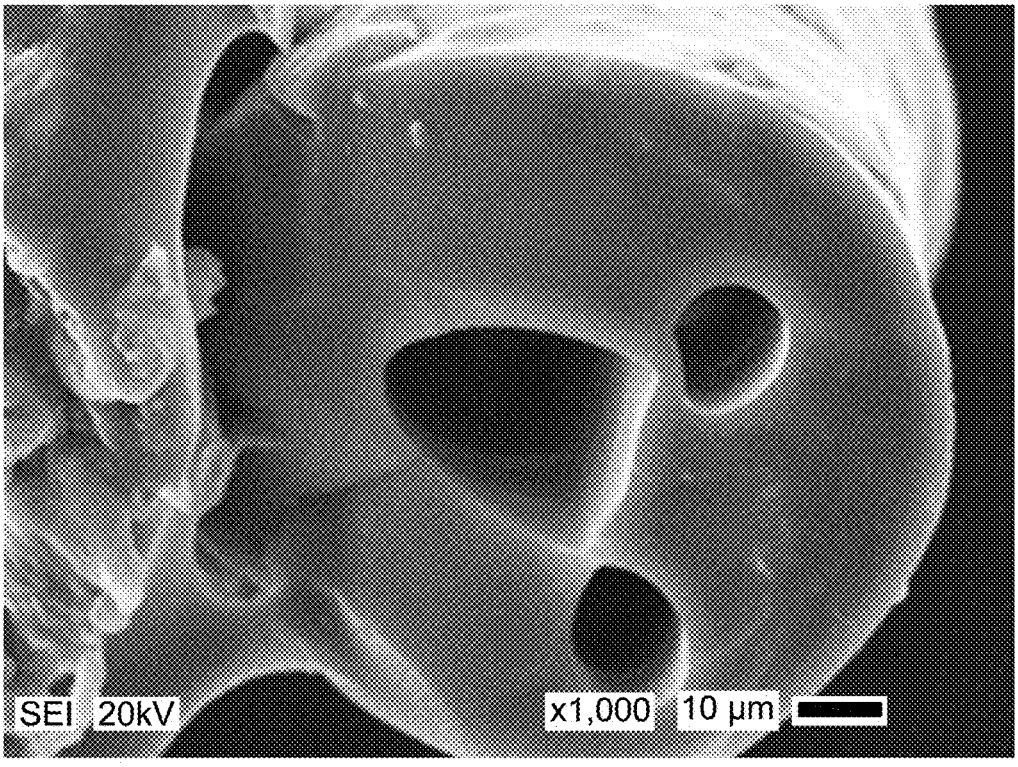
FIG. 8A illustrates a scanning electron microscope (SEM) image showing a cross-sectional view of green fiber from asphaltenes at a scale of 10 micrometres, according to certain embodiments.
Figure 8B:
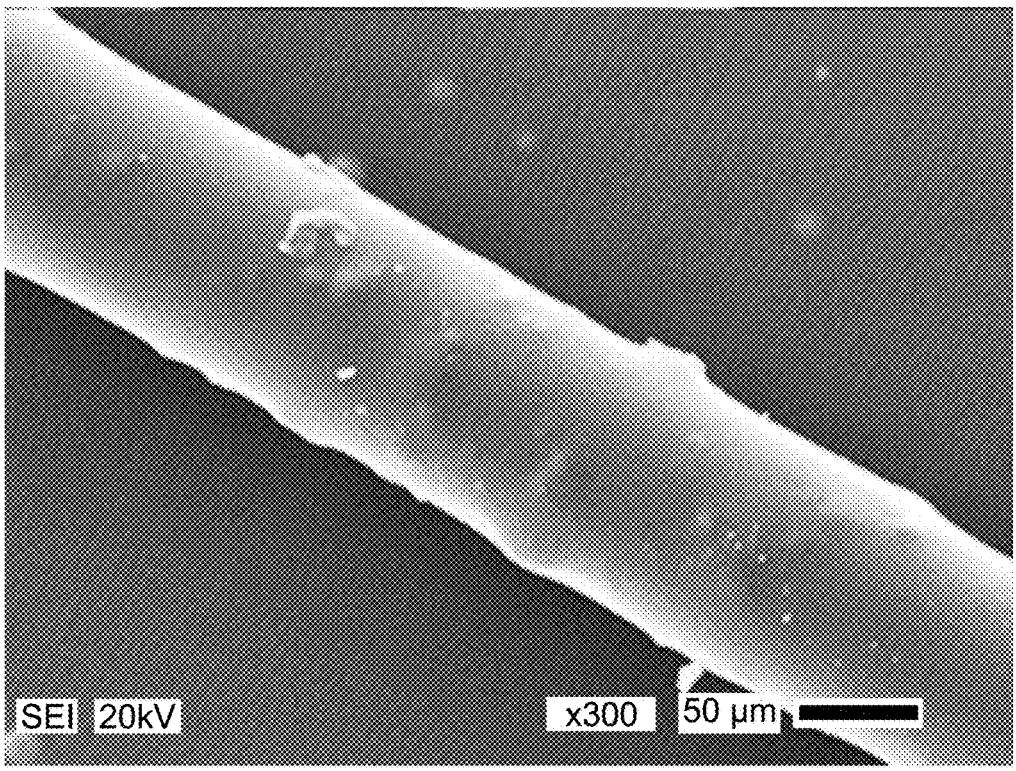
FIG. 8B illustrates a cross-sectional SEM image of green fiber from asphaltenes at a scale of 50 micrometres, according to certain embodiments.
Figure 8C:
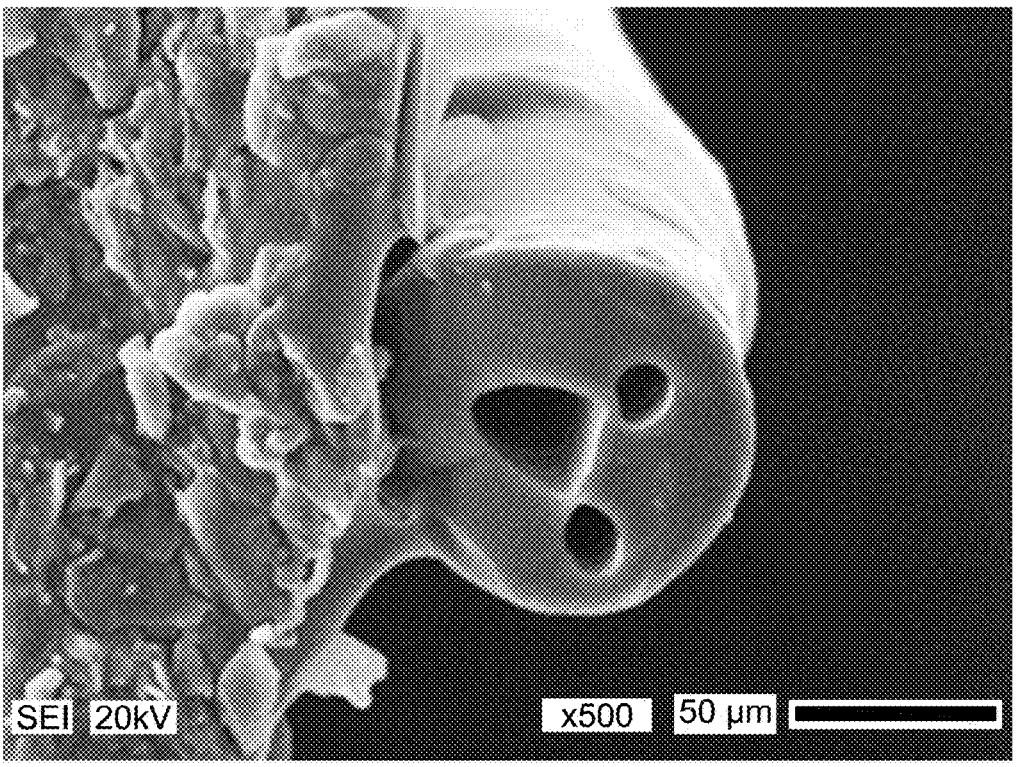
FIG. 8C illustrates a cross-sectional SEM image of green fiber from asphaltenes at a scale of 20 micrometres, according to certain embodiments.
Figure 8D:
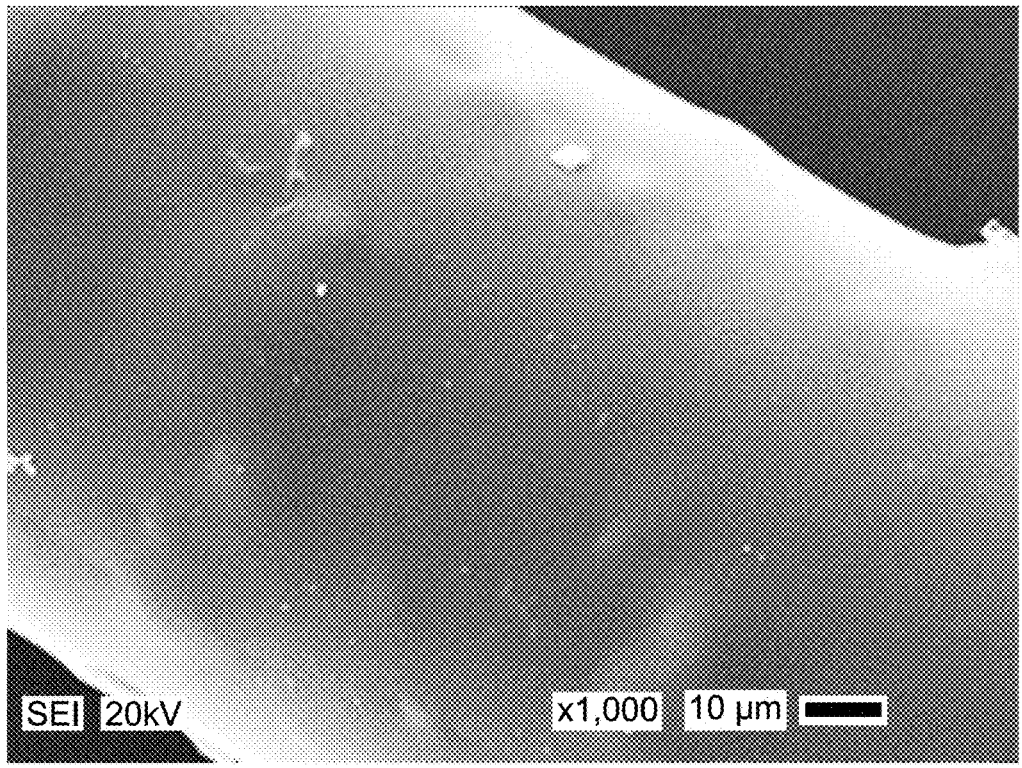
FIG. 8D illustrates a cross-sectional SEM image of green fiber from asphaltenes at a scale of 100 micrometres, according to certain embodiments.
Figure 8E:
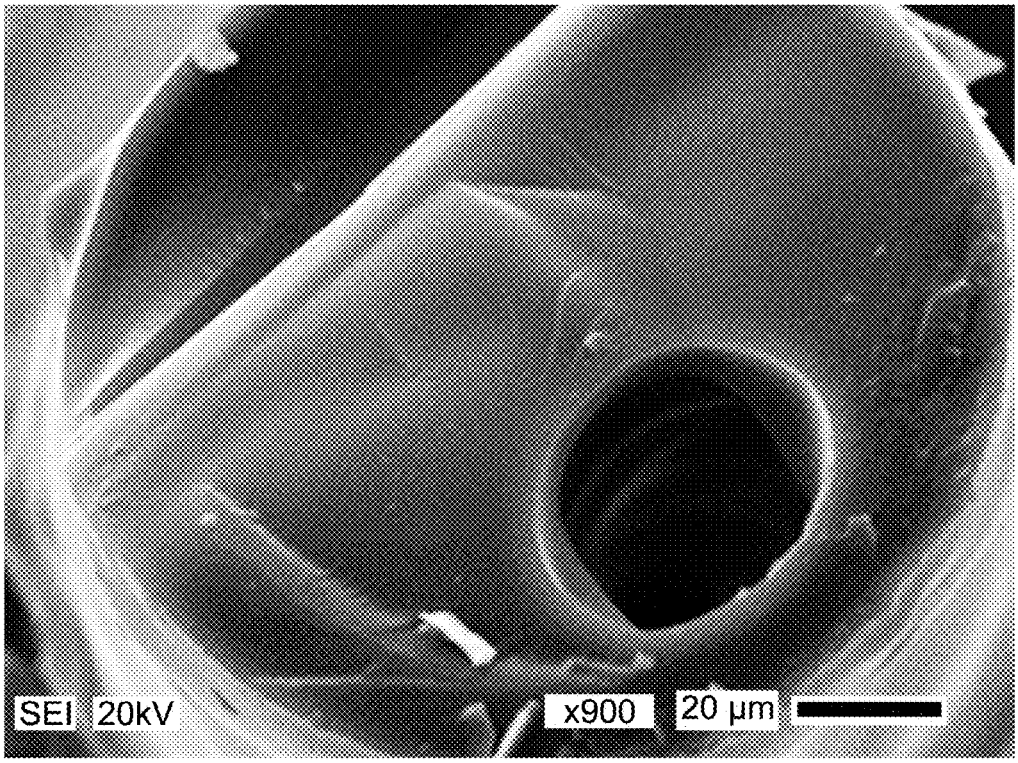
FIG. 8E illustrates a longitudinal SEM view of green fiber from asphaltenes at a scale of 50 micrometres, according to certain embodiments.
Figure 8F:
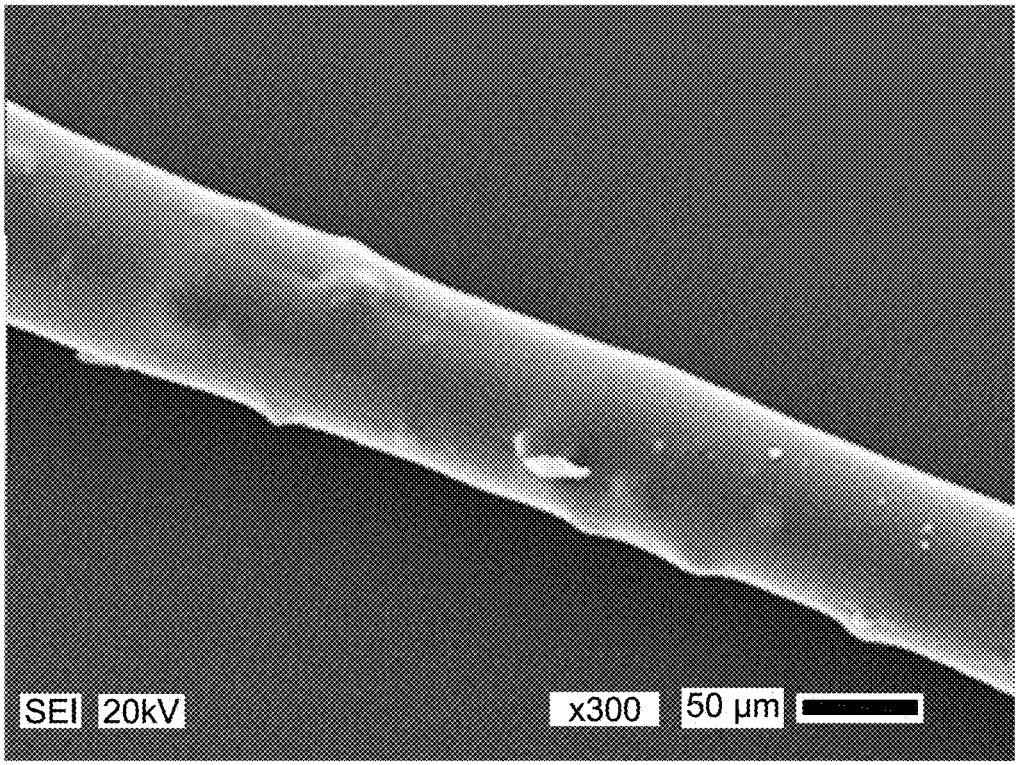
FIG. 8F illustrates a longitudinal SEM view of green fiber from asphaltenes at a scale of 10 micrometres, according to certain embodiments.
Figure 8G:
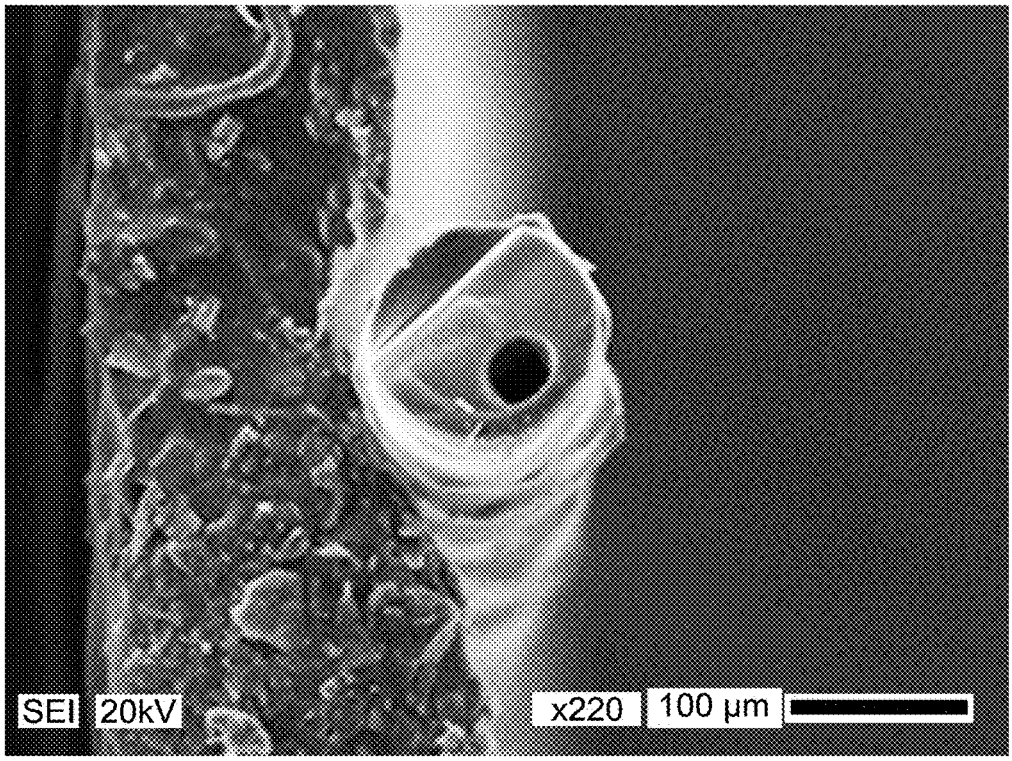
FIG. 8G illustrates another longitudinal SEM image of green fiber from asphaltenes at a scale of 50 micrometres, according to certain embodiments.
Figure 8H:
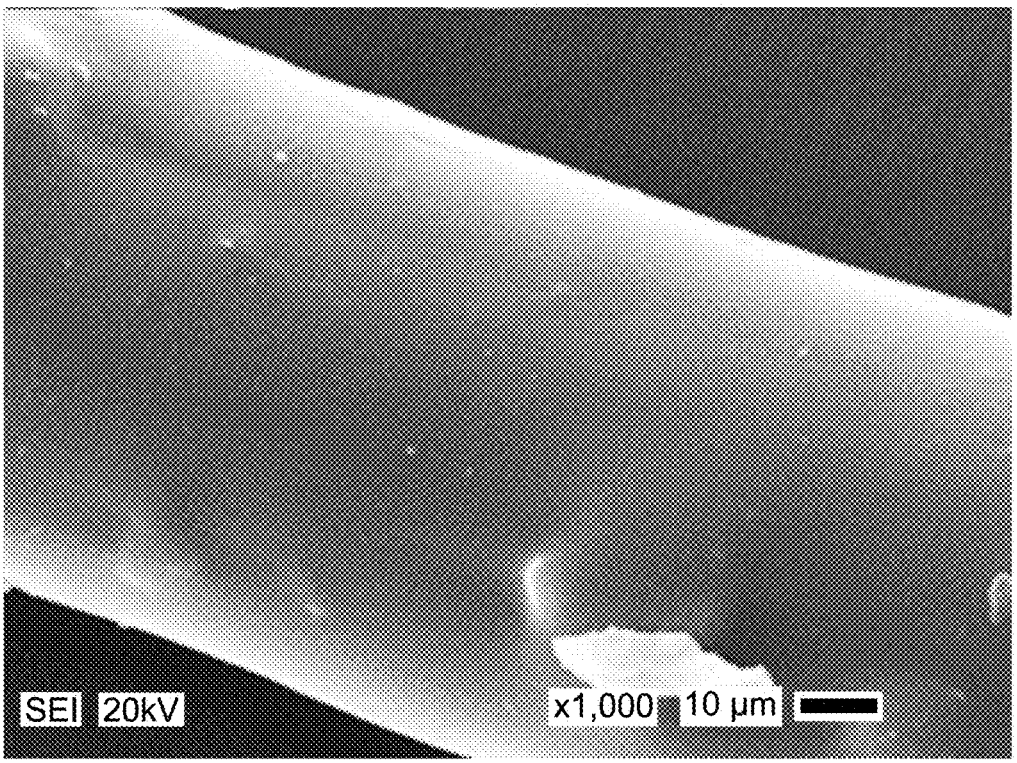
FIG. 8H illustrates another longitudinal SEM image of green fiber from asphaltenes at a scale of 10 micrometres, according to certain embodiments.
Figure 9A:
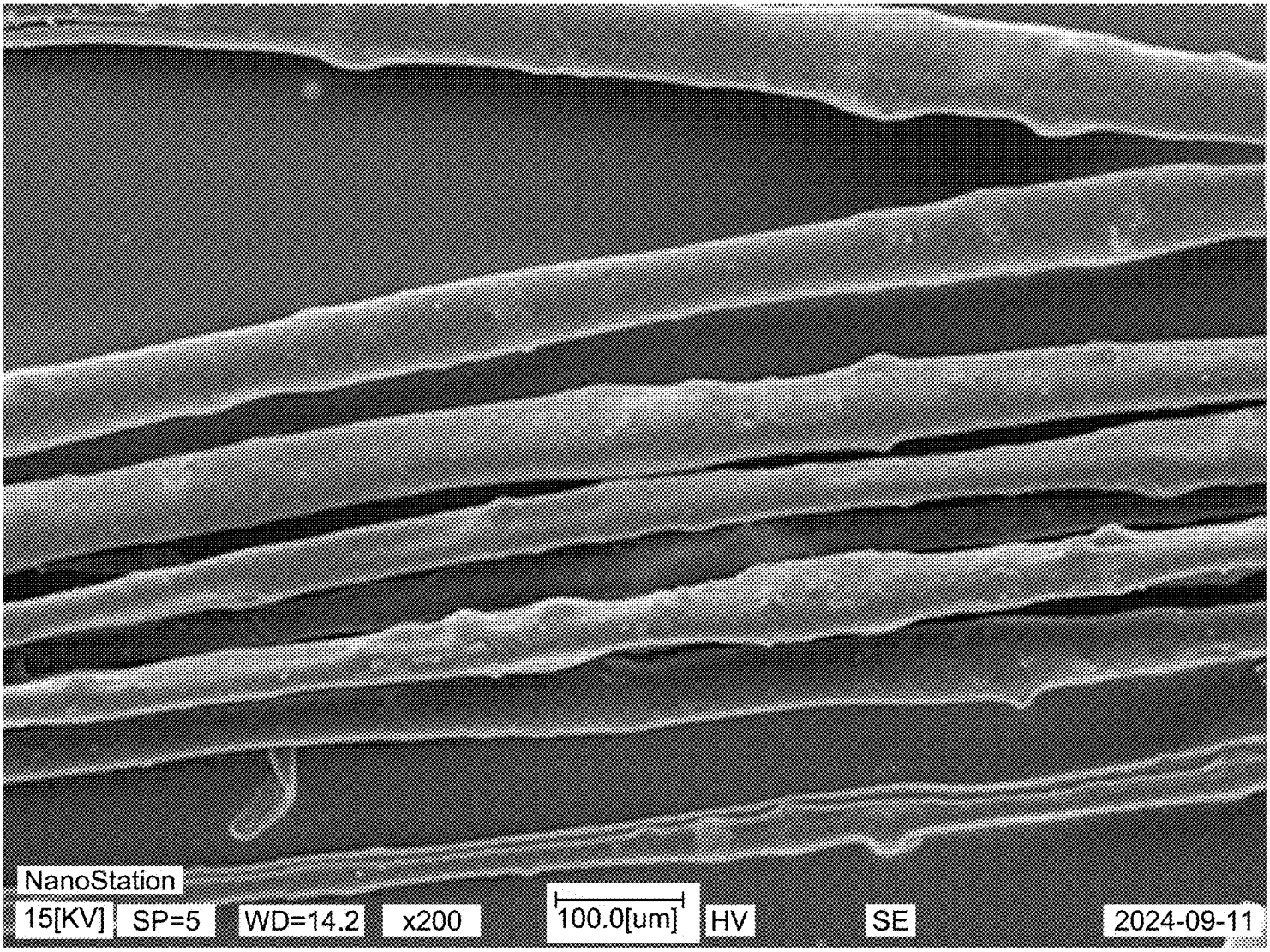
FIG. 9A illustrates a SEM image of carbon fiber derived from asphaltenes at a scale of 100 micrometers, according to certain embodiments.
Figure 9B:
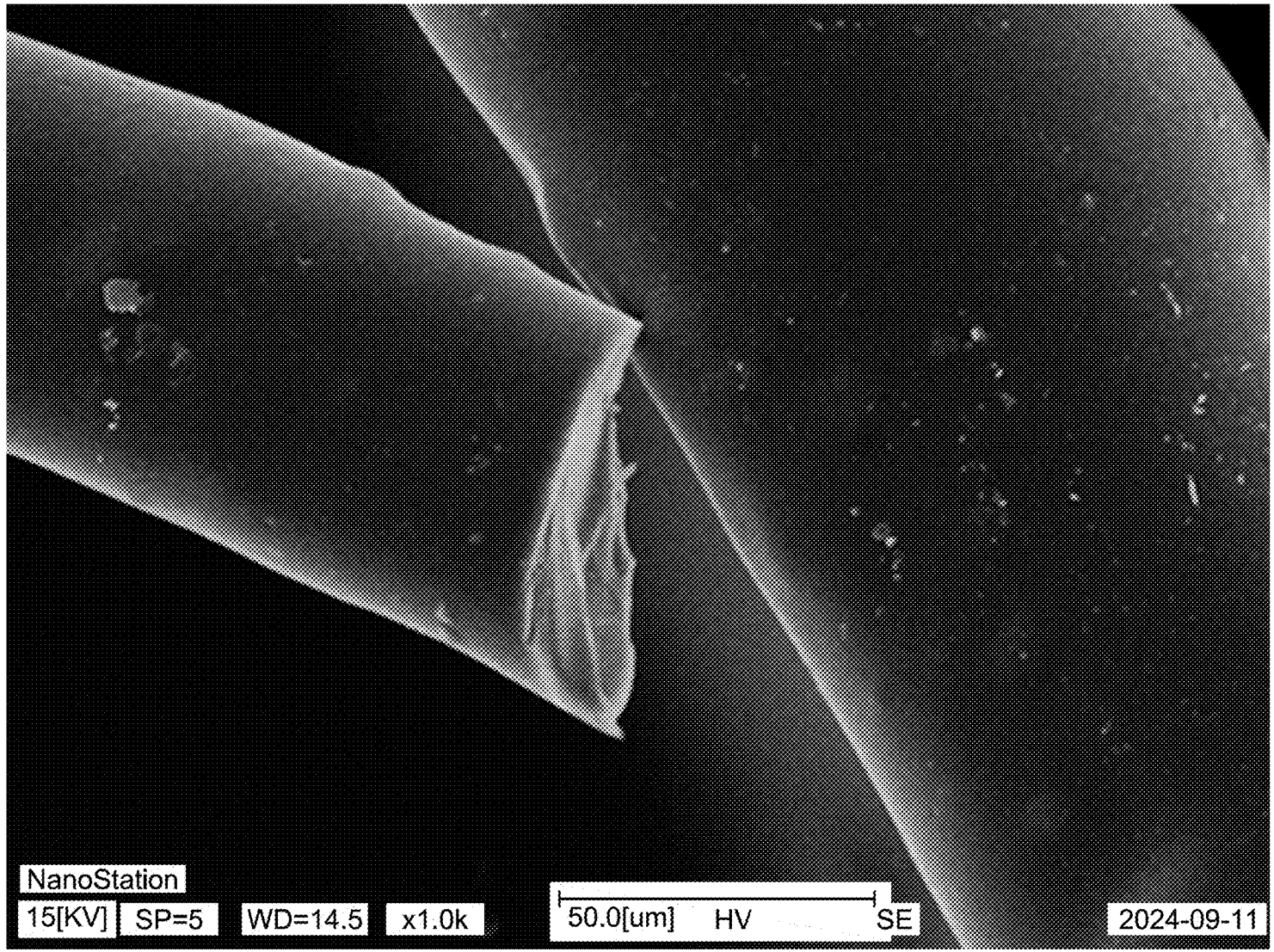
FIG. 9B illustrates an SEM image of carbon fiber from asphaltenes at a scale of 50 micrometres, according to certain embodiments.
Figure 9C:
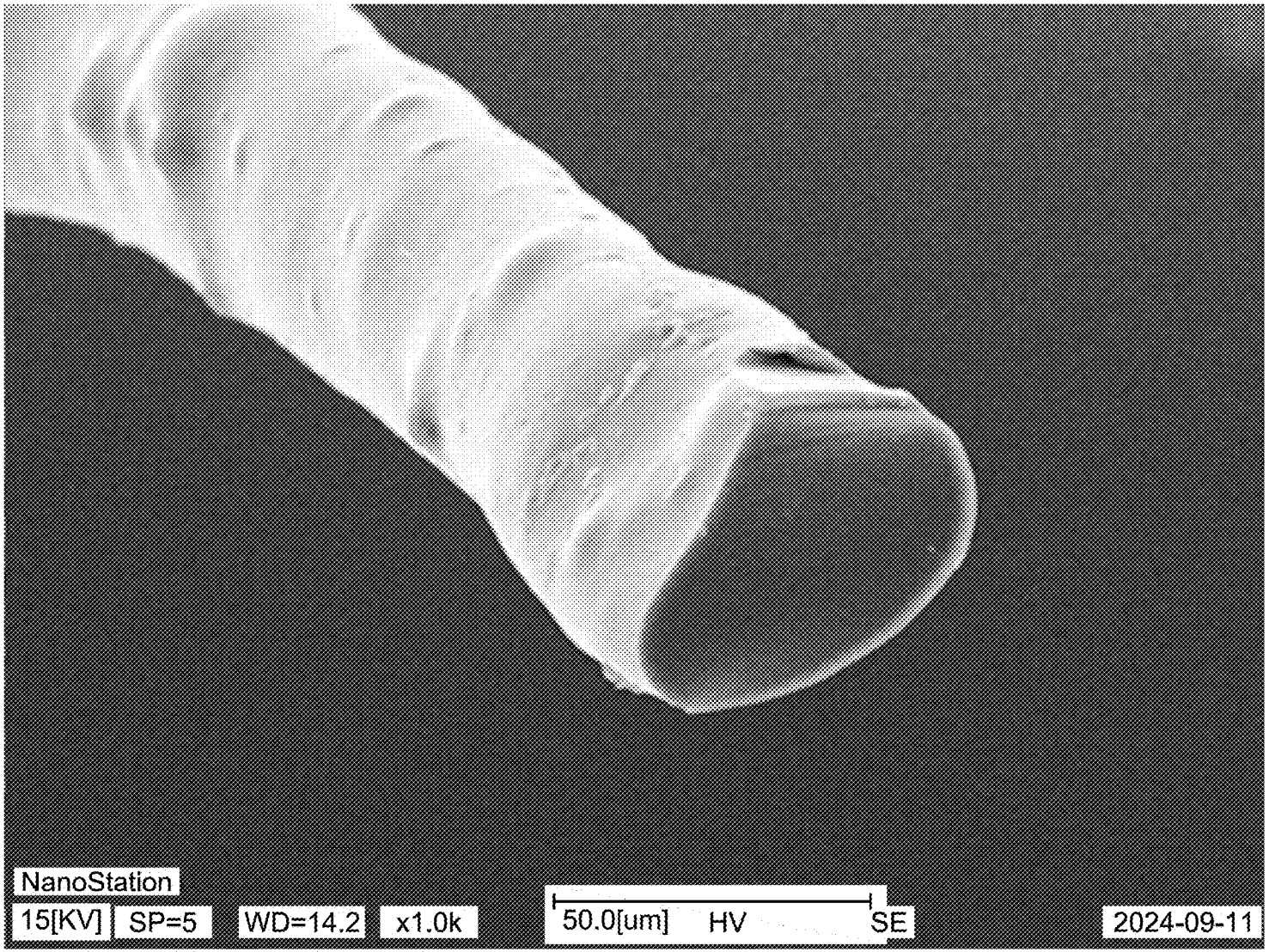
FIG. 9C illustrates an SEM image of carbon fiber from asphaltenes at a scale of 10 micrometres, according to certain embodiments.
Figure 9D:
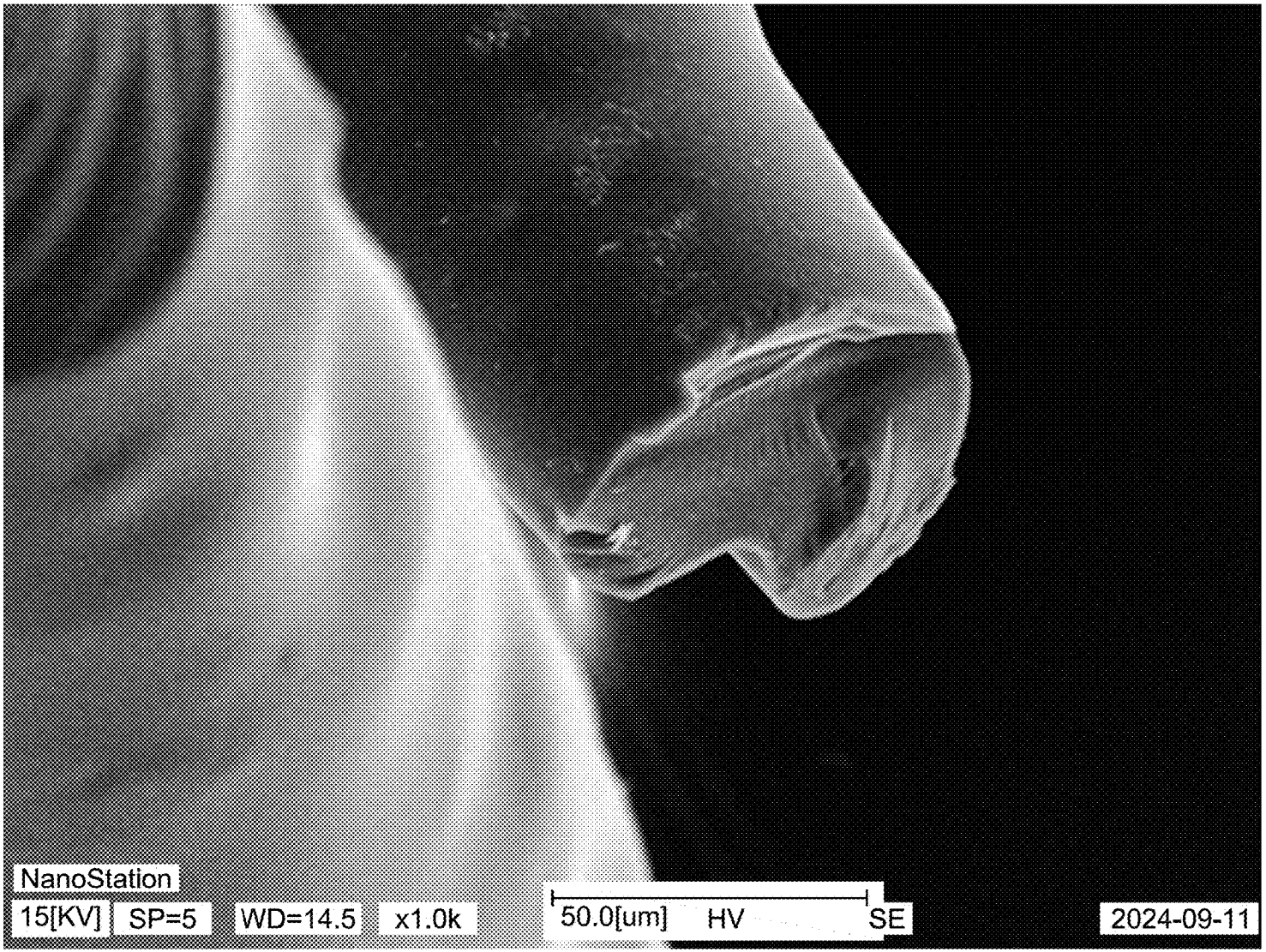
FIG. 9D illustrates a perspective SEM view of carbon fiber from asphaltenes at a scale of 50 micrometres, according to certain embodiments.
Figure 9E:
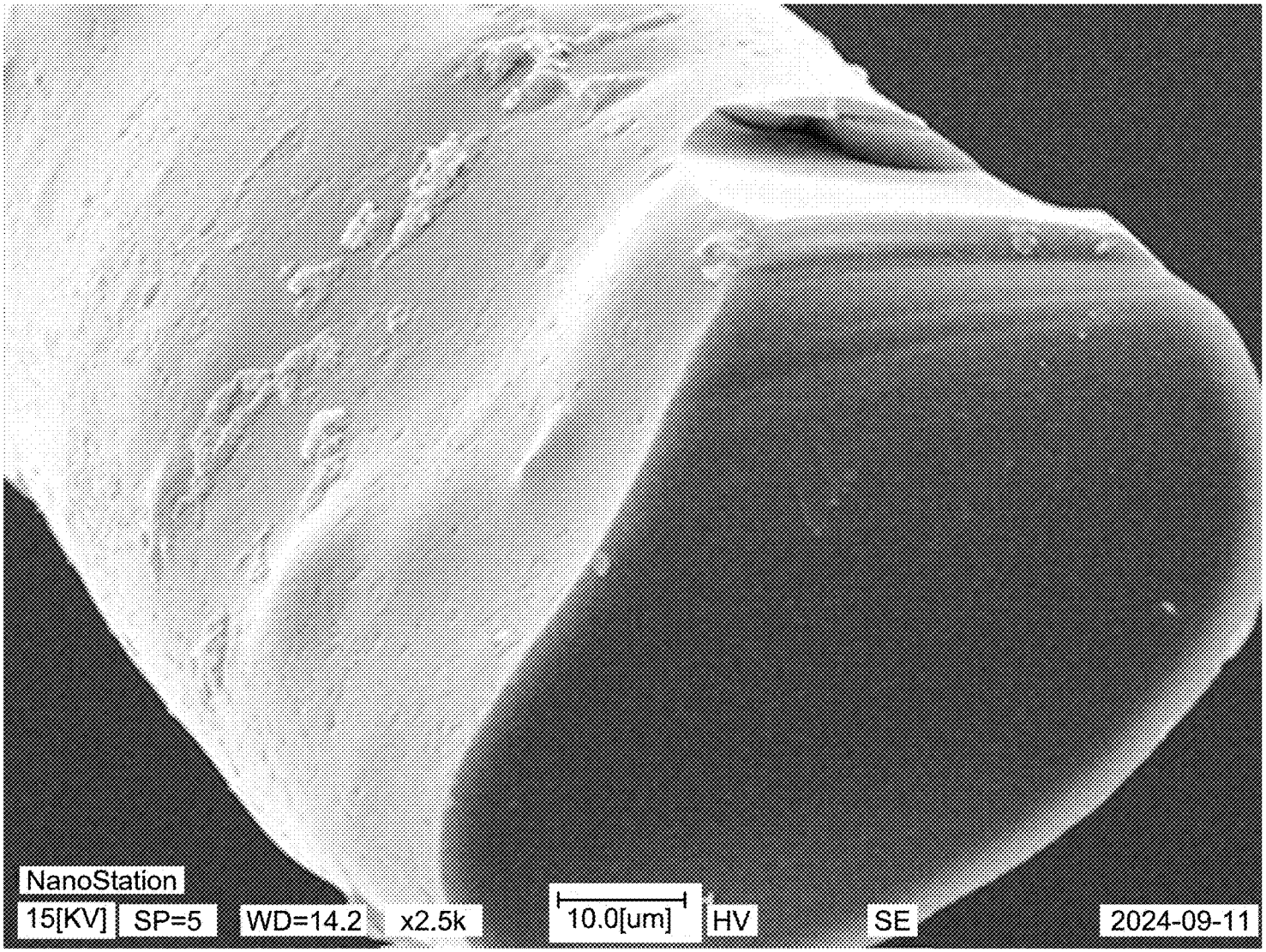
FIG. 9E illustrates another perspective SEM view of carbon fiber from asphaltenes at a scale of 50 micrometres, according to certain embodiments.
Figure 9F:
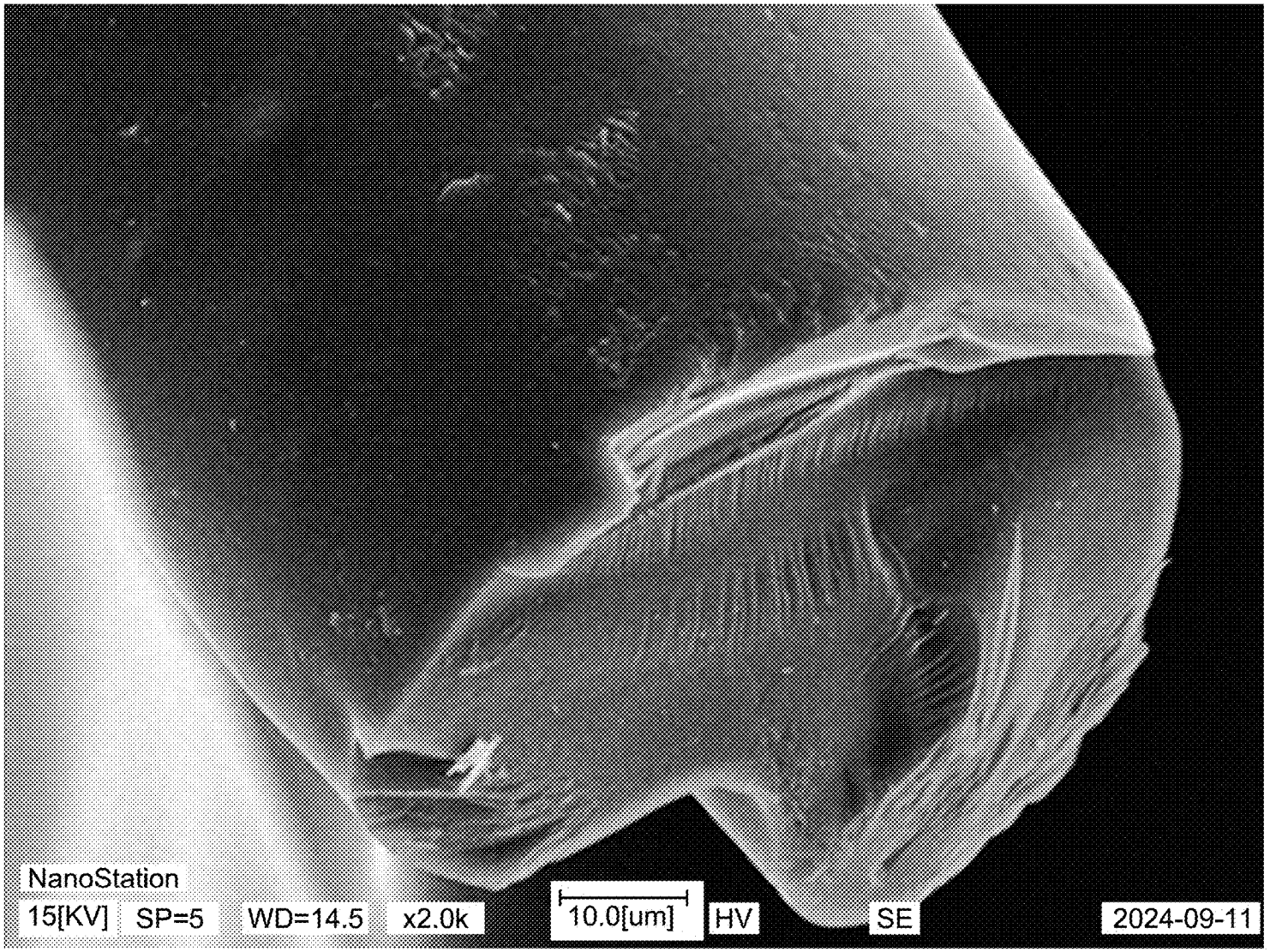
FIG. 9F illustrates a perspective SEM view of carbon fiber from asphaltenes at a scale of 10 micrometres, according to certain embodiments.

Following hydrogen abstraction (Step II), the tetralin molecule may undergo hydrogen disproportionation to form an olefinic intermediate (Structure C), as shown in FIG. 6. The olefinic species is chemically reactive and capable of combining with existing free radicals in the HVGO mixture, including those derived from more complex polyaromatic precursors (such as Structures H and I), as shown in FIG. 6. Additionally, the olefin (C) can participate in self-condensation or dimerization reactions, leading to the formation of structures such as indane or indene-based dimers (Structure D), which have been experimentally confirmed via gas chromatography mass spectrometry (GC-MS) analyses in research.

Furthermore, the dimerized products may undergo further radical coupling reactions with HVGO-derived radicals, giving rise to complex and heavier macromolecular species (Structures F or G), as shown in FIG. 6. The cumulative effect of these transformations is a substantial increase in molecular weight and aromaticity, contributing to the formation of polynuclear aromatic structures. The structures, in turn, may further interact with heteroatoms such as sulfur or nitrogen present in the HVGO matrix, enabling further molecular reconfiguration and stabilization.

The experimental results derived from the present disclosure corroborate the mechanistic framework. For example, in Experiment V (air blowing without mixing at 190° C. for 72 hours with 5 wt. % tetralin), the asphaltenes content reached 47.2 wt. %, the viscosity increased to 117.6 Pa s, and the softening point rose to 210° C. By comparison, under otherwise identical conditions but without tetralin (Experiment U), the asphaltenes content was limited to 39.8 wt. %, viscosity reached only 80.8 Pa s, and the softening point was recorded at 165° C. The results validate the role of tetralin in facilitating controlled molecular growth and promoting the formation of thermally stable, high-softening-point materials, rendering the oxidized HVGO more suitable as a precursor for carbon fiber production and other high-temperature applications.

The suitability of asphaltenes extracted from oxidized heavy vacuum gas oil (HVGO) in the presence of tetralin as a carbon fiber precursor was evaluated by comparison with values reported in the literature, as shown in Table 3. The softening point of the asphaltenes-based precursor obtained in the present disclosure was measured to be approximately 197° C. The aforementioned value lies within the reported literature range of 180° C. to 239° C. The measured softening point corresponds to the thermal processing characteristics required for melt spinning and oxidative stabilization.

TABLE 3

Suitability of produced carbon fiber precursor.

| Property | Present Disclosure | Literature | References |
|---|---|---|---|
| Softening Point | 197° C. | 239° C.<br>180° C. | 1*, 2* |
| Thermal Stability | 800° C. | +950° C. | 3* |
| H/C | 1.04 | 1.14<br>1.26 | 1*, 4* |
| Green Fiber Diameter | 70 μm | 18.1 μm<br>20.3 μm | 4* |

1* Saad, S.; Zeraati, A. S.; Roy, S.; Shahriar Rahman Saadi, M. A.; Radovid, J. R.; Rajeev, A.; Miller, K. A.; Bhattacharyya, S.; Larter, S. R.; Natale, G.; Sundararaj, U.; Ajayan, P. M.; Rahman, M. M.; Kibria, M. G. *Transformation of petroleum asphaltenes to carbon fibers Carbon* 2022, 190, 92-103.

2* Li, M.; Zhang, Y.; Yu, S.; Xie, C.; Liu, D.; Liu, S.; Zhao, R.; Bian, B. *Preparation and characterization of petroleum-based mesophase pitch by thermal condensation with in-process hydrogenation RSC Advances* 2018, 8 (53), 30230-30238.

3* Islam, M. M.; Chen, J.; Ekaette, L; Shahriar, K. A.; Booran, S. K.; Ngo, T. D.; Tang, T.; McDermott, M. T.; Ayranci, C. *Asphaltene-based discontinuous carbon fiber Energy and Fuels* 2024.

4* Kim, Y.; Klerk, A. De; Chen, W. *Rigorous de-asphalting, autoxidation, and bromination pretreatment methods for oilsands bitumen derived asphaltenes to improve carbon fiber production Energy & Fuels,* 2021, 35 (21), 17463-17478.

The suitability of a material for use as a carbon fiber precursor is contingent upon an ability of the material to undergo melt spinning, where the material is extruded through a spinneret to produce continuous fibres. The above-described process necessitates that the material possess defined thermal and rheological characteristics sufficient to enable filament formation without breakage or defect generation. The ability to form green fibres through melt spinning is used as an indicator of precursor suitability for carbon fiber production. Table 4 summarizes the melt-spinning performance of various oxidized HVGO samples, including operational parameters such as processing temperature and spinning rate. In Experiment T, corresponding to air blowing without mixing at 190° C. for 48 hours with 5 wt. % tetralin, and in Experiment V, corresponding to air blowing without mixing at 190° C. for 72 hours with 5 wt. % tetralin, green fiber formation was not achieved. In both cases, material extrusion resulted in the formation of droplets at temperatures up to 210° C. and 240° C., respectively. Similarly, in Experiment U, involving air blowing without mixing at 190° C. for 72 hours without tetralin, droplet formation occurred up to 200° C., and fiber formation was not observed. In contrast, asphaltenes isolated from oxidized HVGO were successfully melt-spun at a processing temperature of 240° C. and a spinning rate of 400 rpm, producing green fibres with an approximate diameter of 70 μm, as shown in FIGS. 8A-8H.

TABLE 4

A summary of melt-spinning conditions and resulted green fibers

| Sample | Spinning Temperature | Spinning rate (rpm) | Comments |
|---|---|---|---|
| Blowing-no mixing + 5% tetralin at 190° C., 48 hr | Not spinnable | Not spinnable | Only droplet came out from the spinneret at up to 210° C. |
| Blowing-no mixing at 190° C., 72 hr | Not spinnable | Not spinnable | Only droplet came out from the spinneret at up to 200° C. |
| Blowing-no mixing + 5% tetralin at 190° C., 72 hr | Not spinnable | Not spinnable | Only droplet came out from the spinneret at up to 240° C. |
| Asphaltenes derived from oxidized HVGO + tetralin | 240° C. | 400 | Produce green fiber with 70 μm diameter |

The inability to produce green fibres in Experiment T (blowing without mixing, with 5 wt. % tetralin at 190° C. for 48 hours), Experiment V (blowing without mixing, with 5 wt. % tetralin at 190° C. for 72 hours), and Experiment U (blowing without mixing at 190° C. for 72 hours without tetralin) is attributed to the presence of additional major components in the oxidized HVGO matrix, including saturates, aromatics, and resins, in conjunction with asphaltenes. The lighter molecular components exhibit lower molecular weights and reduced thermal stability relative to asphaltenes, and therefore do not support melt-spinning under the tested conditions.

Asphaltenes, being compositionally heavier and thermally more stable, are more conducive to the formation of continuous filaments during melt-spinning. By contrast, saturates, aromatics, and resins are comparatively more volatile and lack the rheological characteristics required to sustain filament formation, resulting in droplet formation instead of continuous fibres when subjected to thermal extrusion. With respect to thermal stability, the carbon fiber precursors produced in the present disclosure demonstrated stability up to approximately 800° C. This thermal stability is marginally below the reference value of approximately 950° C. reported in the literature for comparable materials.

Elemental analysis indicated that the hydrogen-to-carbon (H/C) atomic ratio of the asphaltenes-based precursor material was approximately 1.04, which is lower than the literature-reported range of 1.14 to 1.26. The lower H/C ratio reflects a comparatively higher degree of aromatization relative to conventional precursor materials. Further, the green fiber diameter obtained in the present disclosure was measured at approximately 70 μm. The aforesaid value is greater than the range reported in literature, which lies between approximately 18.1 μm and 20.3 μm. The increased fiber diameter corresponds to a spinning speed of 400 rpm used during melt-spinning.

The production of carbon fibres from asphaltenes was carried out through a process including oxidative stabilization followed by carbonization, intended to modify the physical and chemical characteristics of the precursor material. Carbon fibres were produced from asphaltenes extracted from autoxidized heavy vacuum gas oil (HVGO) containing 5 wt. % tetralin (Experiment V), using the stabilization and carbonization procedures. The resulting carbon fibres exhibited reduced diameters in the range of approximately 40 to 50 μm, as shown in FIGS. 9A-9F. The fiber diameter exceeds the literature-reported range of 3.5 to 5 μm. The difference in diameter may be attributed to the carbonization temperature of 800° C., which may not have facilitated complete removal of heteroatoms and other non-carbon constituents.

Figure 10:
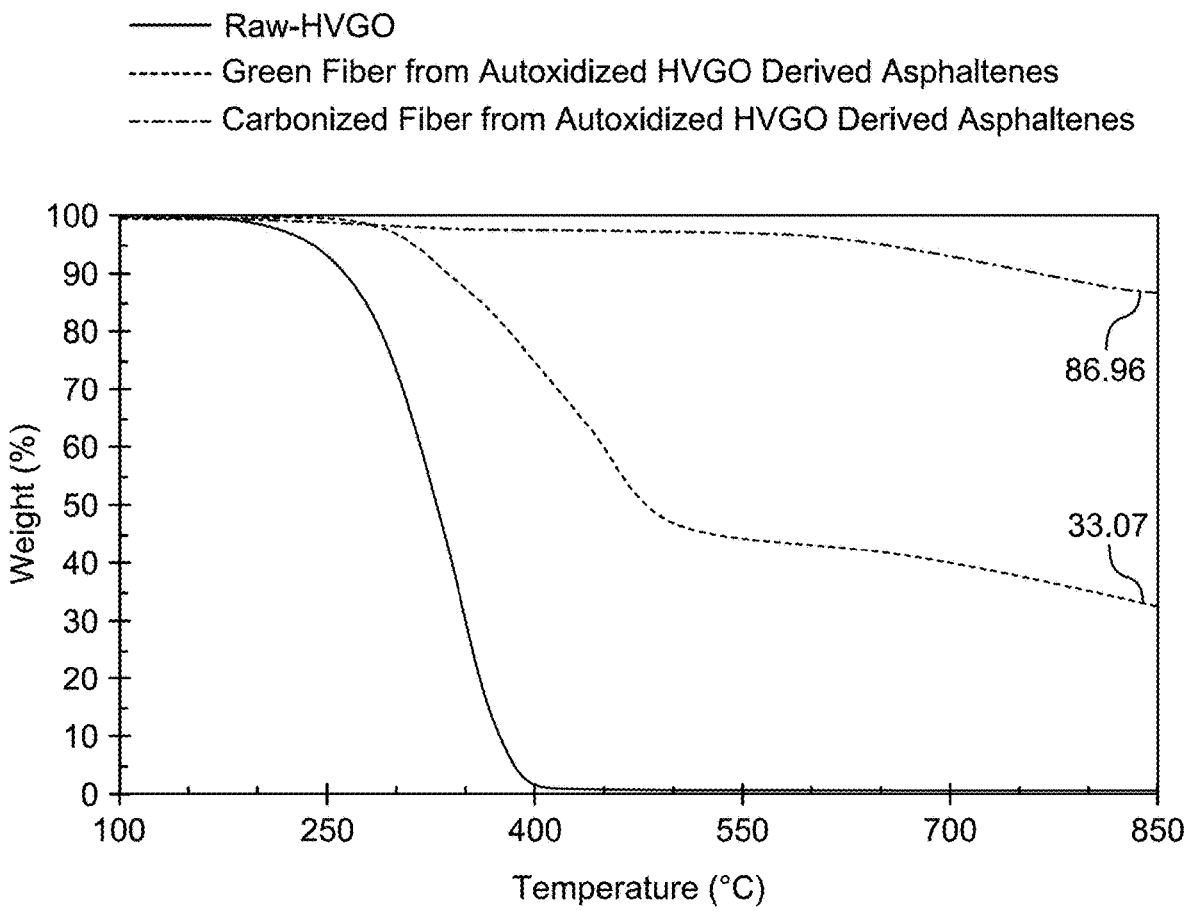
FIG. 10 illustrates thermogravimetric analysis (TGA) thermograms for raw HVGO, green fiber, and carbon fiber derived from autoxidized HVGO-based asphaltenes, according to certain embodiments.

Furthermore, in order to evaluate the thermal stability of the resulting carbon fibres, thermogravimetric analysis (TGA) was performed. As illustrated in FIG. 10, the TGA curve for raw HVGO displayed significant mass loss predominantly between approximately 230° C. and 400° C., corresponding to the steepest slope on the curve and indicative of thermally unstable behaviour. In comparison, the green fiber demonstrated a broader thermal degradation range with a reduced slope, consistent with an increase in thermal stability. The TGA profile of the carbonized fiber exhibited a horizontal trace, indicating minimal mass loss over the tested temperature range and indicating thermal stabilization of the material.

Figure 11:
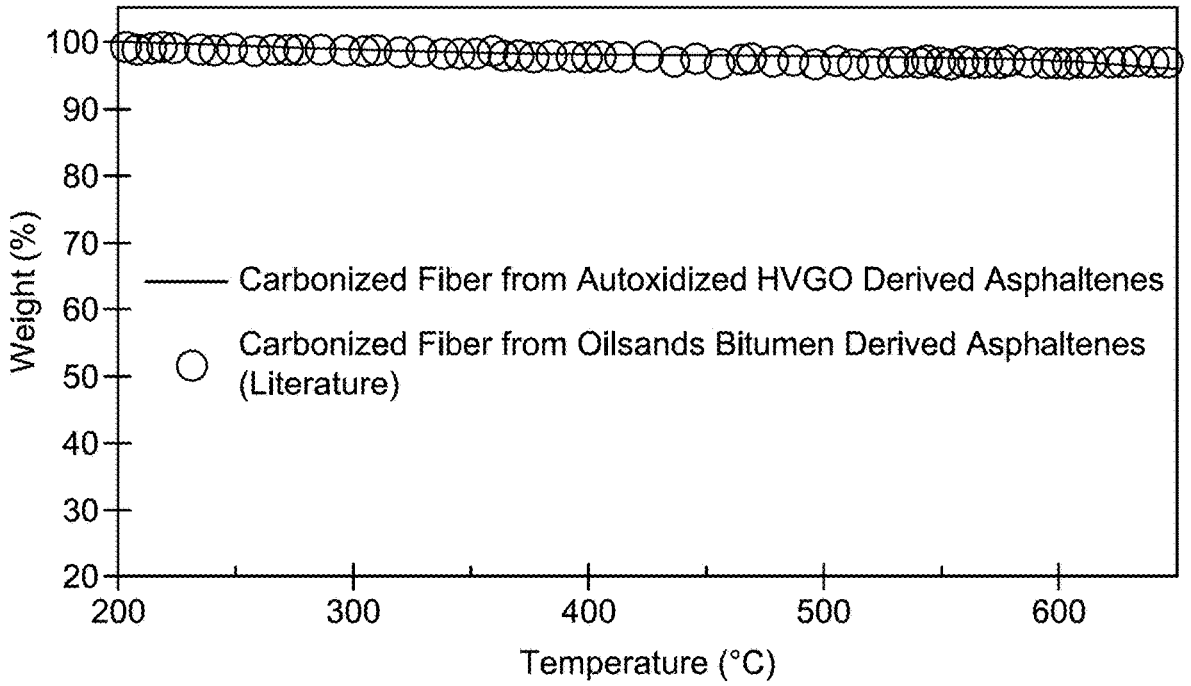
FIG. 11 illustrates a comparison of carbon fiber derived from autoxidized HVGO-based asphaltenes with literature-reported carbon fiber data, according to certain embodiments.

The TGA thermogram of the carbonized fiber was further validated against literature data, as shown in FIG. 11, which presents a comparative thermogram of carbonized fibres derived from HVGO-based asphaltenes and from oilsands bitumen-based asphaltenes. The overlapping of the two thermograms indicates consistency between the thermal degradation behaviour of the two carbonized materials.

The aspects of the present disclosure provide controlled autoxidation of heavy vacuum gas oil (HVGO) to facilitate the generation of asphaltenes suitable for carbon fiber production. The present disclosure demonstrates that the oxygen addition method, oxidation temperature, and the inclusion of naphthenic aromatic hydrocarbons such as tetralin govern the transformation of HVGO into a composition with enhanced asphaltenes content and modified physicochemical properties. The controlled introduction of oxygen, particularly through air blowing without mixing at elevated temperatures and extended reaction durations, was effective in generating high asphaltenes concentrations. The asphaltenes obtained through such processing exhibited thermal and rheological characteristics appropriate for melt-spinning, enabling the formation of green fibers that could subsequently undergo acid treatment, oxidative stabilization, and carbonization. The carbon fibers produced through the method demonstrated herein, provided thermal stability and morphological characteristics comparable to those derived from conventional precursors. Accordingly, the present disclosure provides a systematic route for converting low-value heavy petroleum fractions into structured carbonaceous materials through thermochemical transformation of in situ-generated asphaltenes.

Numerous modifications and variations of the present disclosure are possible in light of the above teachings. It is therefore to be understood that within the scope of the appended claims, the invention may be practiced otherwise than as specifically described herein.

The invention claimed is:

1. A method of forming a carbon fiber, the method comprising heat treating a heavy vacuum gas oil at a heat treatment temperature of 150 to 225° C. with a gas mixture comprising oxygen to form an oxidized HVGO;

collecting asphaltenes from the oxidized HVGO;

melt spinning the asphaltenes to form a raw filament;

treating the raw filament with a mineral acid to form an acid-treated filament;

oxidizing the acid-treated filament by heating the acid-treated filament in air at a temperature of 140 to 175° C. to form an oxidized filament; and carbonizing the oxidized filament by heating the oxidized filament under an inert atmosphere at a temperature of 700 to 900° C. to form the carbon fiber.

2. The method of claim 1, wherein the heat treatment is performed at a heat treatment temperature of 150 to 190° C.

3. The method of claim 1, wherein the heavy vacuum gas oil is substantially free of asphaltenes.

4. The method of claim 1, wherein the heavy vacuum gas oil comprises 35 to 50 wt. % saturates;

45 to 60 wt. % aromatics; and 2.5 to 10 wt. % resins, each based on a total weight of heavy vacuum gas oil.

5. The method of claim 1, wherein the heavy vacuum gas oil comprises 80 to 90 wt. % carbon;

7.5 to 15 wt. % hydrogen;

1 to 5 wt. % sulfur; and 0.1 to 1 wt. % oxygen, each based on a total weight of heavy vacuum gas oil.

6. The method of claim 1, wherein the heat treating involves bubbling the gas mixture through the heavy vacuum gas oil without mixing.

7. The method of claim 1, wherein the heat treating involves bubbling the gas mixture through the heavy vacuum gas oil with mixing.

8. The method of claim 7, wherein the mixing is performed at 50 to 500 rpm.

9. The method of claim 1, wherein the heavy vacuum gas oil is a tetralin-supplemented heavy vacuum gas oil comprising 1 to 30 wt. % tetralin, based on a total weight of tetralin-supplemented heavy vacuum gas oil.

10. The method of claim 1, wherein the oxidized HVGO comprises 12.5 to 57.5 wt. % asphaltenes, based on a total weight of oxidized HVGO.

11. The method of claim 1, wherein the oxidized HVGO has a viscosity at 25° C. of 1 to 125 Pa s.

12. The method of claim 1, wherein the melt spinning is performed at a temperature of 210 to 270° C. and a spinning rate of 250 to 550 rpm.

13. The method of claim 1, wherein the mineral acid is nitric acid.

14. The method of claim 13, wherein the nitric acid has a concentration of 30 to 50 wt. % in water.

15. The method of claim 1, wherein the raw filament has a mean diameter of 25 to 125 μm.

16. The method of claim 1, wherein the raw filament has a hydrogen to carbon atomic ratio of 0.90 to 1.15.

17. The method of claim 1, wherein the raw filament has a softening point of 175 to 225° C.

18. The method of claim 1, wherein the carbon fiber has a mean diameter of 15 to 75 μm.

19. The method of claim 1, wherein the collecting asphaltenes is performed by solvent precipitation.

20. The method of claim 19, wherein the solvent is n-heptane.

* * * * *